US006588051B2

(12) United States Patent
Hashizume et al.

(10) Patent No.: US 6,588,051 B2
(45) Date of Patent: Jul. 8, 2003

(54) ELECTRIC VACUUM CLEANER HAVING A STRUCTURE FOR FACILITATING THE MANUFACTURABILITY THEREOF

(75) Inventors: Kiyoshi Hashizume, Shiga (JP); Koichi Ito, Shiga (JP); Kenichiro Sunaba, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/770,636

(22) Filed: Jan. 29, 2001

(65) Prior Publication Data

US 2001/0018780 A1 Sep. 6, 2001

(30) Foreign Application Priority Data

| | | |
|---|---|---|
| Jan. 31, 2000 | (JP) | 2000-021634 |
| Feb. 9, 2000 | (JP) | 2000-031414 |
| Feb. 18, 2000 | (JP) | 2000-040601 |
| Jun. 15, 2000 | (JP) | 2000-179651 |

(51) Int. Cl.[7] ..... A47L 9/26
(52) U.S. Cl. ..... 15/323; 15/351
(58) Field of Search ..... 15/351, 319, 339, 15/1, 350, 323

(56) References Cited

U.S. PATENT DOCUMENTS

| | | | | |
|---|---|---|---|---|
| 3,218,783 A | * | 11/1965 | Ripple | 15/350 |
| 3,763,635 A | * | 10/1973 | Schmitz | 15/351 |
| 4,294,595 A | * | 10/1981 | Bowerman | 15/339 |
| 4,514,199 A | * | 4/1985 | Ford et al. | 15/352 |
| 4,724,574 A | * | 2/1988 | Bowerman et al. | 15/351 |
| 4,905,341 A | * | 3/1990 | Sunagawa et al. | 15/339 |
| 5,134,752 A | * | 8/1992 | Shipman | 15/351 |
| 5,144,714 A | * | 9/1992 | Mori et al. | 15/319 |
| 5,168,598 A | * | 12/1992 | Hashizume et al. | 15/351 |
| 5,608,946 A | * | 3/1997 | Rennecker et al. | 15/339 |
| 5,907,889 A | * | 6/1999 | Fukushima et al. | 15/339 |
| 6,085,382 A | * | 7/2000 | Bobrosky et al. | 15/350 |
| 6,098,242 A | * | 8/2000 | Choi | 15/351 |
| 6,115,880 A | * | 9/2000 | Wulff et al. | 15/351 |

* cited by examiner

*Primary Examiner*—Theresa T. Snider
(74) *Attorney, Agent, or Firm*—McDermott, Will & Emery

(57) ABSTRACT

An electric vacuum cleaner according to the present invention includes a cleaner main body 16, and a suction unit 24 which is rotatably disposed at the bottom of the cleaner main body 16 and includes a suction port 23 and a rotary brush 25. The cleaner main body 16 includes a dust collecting chamber 19, and a fan chamber 18 equipped with an electric fan 17 disposed at the bottom thereof. A handle 21 having a grip portion 20 and a control circuit board 22 are installed above the dust collecting chamber 19. Components such as the handle 21 and the electric fan 17 are installed at the rear of the cleaner main body 16. With this configuration, the vacuum cleaner is prevented from falling down when it is set upright. Further, the safety in use of the vacuum cleaner will be improved. Also, the user is able to easily use the vacuum cleaner. Furthermore, it is possible to finish assembling the component parts only at the rear of the vacuum cleaner. Accordingly, the number of parts to be assembled and disassembled can be decreased. Also, it is possible to shorten the time required for the assembling job and, further, to improve the workability.

7 Claims, 34 Drawing Sheets

ELECTRIC VACUUM CLEANER HAVING A STRUCTURE FOR FACILITATING THE MANUFACTURABILITY THEREOF

FIELD OF THE INVENTION

The present invention relates to an upright electric vacuum cleaner having a suction unit rotatably disposed at the bottom of the cleaner main body, and a vacuum cleaner hose unit that provides communication between a dust collecting chamber and the suction unit.

BACKGROUND OF THE INVENTION

Hitherto, an electric vacuum cleaner of this type has been configured as shown in FIG. 34. The configuration will be described in the following.

As shown in FIG. 34, a suction unit 2 includes a rotary brush 1, and the rotary brush 1 is rotatably installed at the bottom of a cleaner main body 3. A fan chamber 5 furnished with an electric fan 4 is disposed at the bottom of the cleaner main body 3. A dust collecting chamber 6 is disposed above the fan chamber 5. A handle 7 and a control circuit board 8 for the electric fan 4 are arranged further above the dust collecting chamber 6. A cord winding device 9 is disposed at the back of the dust collecting chamber 6.

The control circuit board 8 is covered with a cover 10 at the front of cleaner main body 3. The cord winding device 9 is covered with a cord winding device cover 11 at the rear of cleaner main body 3. Also, the electric fan 4 is covered and held with a motor cover 12 at the front of cleaner main body 3.

Also, when the vacuum cleaner is not used with its main body kept upright, the handle is turned, and a part of the turned handle is abutted against the floor so that the cleaner main body is prevented from falling down.

Also, a hose unit which provides communication between the dust collecting chamber of the cleaner main body and the suction unit is, as shown in FIG. 35, provided with screw thread 13*a* disposed on the inner wall of a connection pipe 13, and an adhesive agent 13*b* is applied to the grooves of thread 13*a*. The end of hose 14 is screwed in along the thread 13*a* of the connection pipe 13. Thus, the adhesive agent 13*b* hardens to secure the hose 14 and connection pipe 13, and thereby the hose unit 15 is formed.

However, in an electric vacuum cleaner as shown in FIG. 34, when the electric fan 4 is assembled, the front portion of cleaner main body 3 is first assembled, followed by installation of the motor cover 12. On the other hand, when the cord tape-up device 9 is assembled, the rear portion of cleaner main body 3 is first assembled, followed by installation of the cord winding device cover 11. During the assembling job, it is necessary to properly turn around the cleaner main body 3, making the assembling job bothersome. Similarly, when the electric vacuum cleaner is disassembled for a servicing purpose, it is also necessary to properly turn around the cleaner main body 3, making the job troublesome.

Further, when the vacuum cleaner is not used with its main body kept upright, the handle is turned, a part of the turned handle is abutted against the floor so that the cleaner main body is prevented from falling down. Accordingly, the user has to turn the handle each time, and it causes a nuisance to the user. Furthermore, a handle turning mechanism is disposed at the root portion of the handle, causing a considerable limit to the design.

Also, in an electric vacuum cleaner having a removable hose, when the rear portion of the cleaner main body is cleaned, removing the hose and fitting an attachment or the like thereto, there is a fear of falling down of the cleaner main body.

Further, in the case of using a hose unit as shown in FIG. 35, the hose unit includes the screw thread 13*a* arranged on the inner wall of connection pipe 13, causing the die cost to become higher and the molding cycle time to become longer, resulting in higher molding costs. Also, since it is difficult to provide the crest and bottom of the screw thread 13*a* with a great difference in level, making it absolutely necessary to use the adhesive agent 13*b* to secure the connection pipe 13 and the hose 14. Furthermore, the adhesive agent 13*b* may flow into the connection pipe 13 or the hose 14 during the connecting job. In addition, there is a fear of air leakage due to insufficient adhesion. Also, there exist problems of inadequate adhesion and longer hardening time of the adhesive agent. Thus, a conventional electric vacuum cleaner has many problems to be solved.

SUMMARY OF THE INVENTION

It is the primary object of the present invention to reduce the product costs by decreasing the number of components to be assembled and disassembled, and also to shorten the time required for assembling the components and to improve the workability.

Also, it is the second object of the present invention to obtain an electric vacuum cleaner such that, when the vacuum cleaner is not used with its main body kept upright, the user is not required to operate a handle or any other preventive mechanism to prevent the cleaner main body from falling down, thereby improving the usability and the design convenience including the handle.

Further, it is the third object of the present invention to obtain an electric vacuum cleaner such that, when the rear portion of the cleaner main body is cleaned, removing the hose from the suction unit and fitting an attachment or the like thereto, the cleaner main body does not fall down even if the hose is strongly pulled backward, thereby improving the safety and the usability.

Also, it is the fourth object of the present invention to provide a high-quality hose unit for electric vacuum cleaners.

An electric vacuum cleaner to achieve the primary object of the present invention comprises a cleaner main body, and a suction unit which is rotatably disposed at the bottom of the cleaner main body and is provided with a suction port and a rotary brush, wherein the cleaner main body includes a dust collecting chamber disposed above a fan chamber equipped with an electric fan disposed at the bottom thereof, and a handle having a grip portion and a control circuit board above the dust collecting chamber. The components such as the handle and the electric fan are installed at the rear of cleaner main body.

In this way, since the components of the handle and the electric fan or the like are installed only at the rear of cleaner main body, it is not necessary to turn around the cleaner main body when assembling the components. So, the number of components to be assembled and disassembled may be decreased, resulting in lower product costs. Further, it is possible to shorten the time required for the assembling job and to improve the workability.

Also, in an electric vacuum cleaner to achieve the second object of the present invention, a cleaner main body having a dust bag furnished with an electric fan is mounted for universal movement on a suction unit having a suction port to take in dust, and a support portion is retractably or rotatably disposed on the cleaner main body in order to support the cleaner main body. The support portion nearly abuts on the floor surface only when the cleaner main body is in an upright position due to a mechanism formed at a part of the cleaner main body. The configuration is such that the support portion's abutment on the floor surface is outside the plane projected on the floor surface by the caster roller and the front end of the suction unit.

Thus, when the cleaner main body is set upright after using, the support portion is automatically abutted on the floor surface by the function of a cam mechanism so that the cleaner main body is hard to fall down. The user is able to make the cleaner main body hard to fall down without operating a handle or any other preventive mechanism, and it is possible to improve the usability and the design convenience including the handle.

Also, in an electric vacuum cleaner to achieve the third object of the present invention, a cleaner main body equipped with a dust collecting chamber and an electric fan is mounted for universal movement on a suction unit having a suction port to take in dust, and a connection hose detachably connected to the suction unit provides communication between the suction unit and the dust collecting chamber, and a support portion is retractably disposed on the cleaner main body in order to make the cleaner main body hard to fall down. When the hose is disconnected from the suction unit, the support portion protrudes behind the rotational center of the caster roller.

With this configuration, when the rear portion of the cleaner main body is cleaned, removing the hose from the suction unit and fitting an attachment or the like thereto, the cleaner main body does not fall down even if the hose is strongly pulled backward, and thereby it is possible to improve the safety and the usability.

Also, a hose unit for electric vacuum cleaners to achieve the fourth object of the present invention comprises a hose and a hose cover. The hose cover has a cylindrical portion in which the hose is inserted, and an opening is formed in a part of the cylindrical portion, and there is provided a protrusion on the inner wall of the cylindrical portion along the opening.

With this configuration, it is possible to structurally simplify the die to be used and to lower the cost. Also, the hose may be assembled without using an adhesive agent since the hose is guided by the protrusion, and thereby it is possible to improve the assembling workability and to obtain a high-quality hose unit for electric vacuum cleaners.

BRIEF DESCRIPTION OF THE DRAWINGS

FIG. 32(*b*) is a side view of the hose cover of the hose unit for electric vacuum cleaners.

DESCRIPTION OF THE PREFERRED EMBODIMENTS

The first embodiment of the present invention will be described in the following with reference to FIG. 1~FIG. 4.

Figure 1:
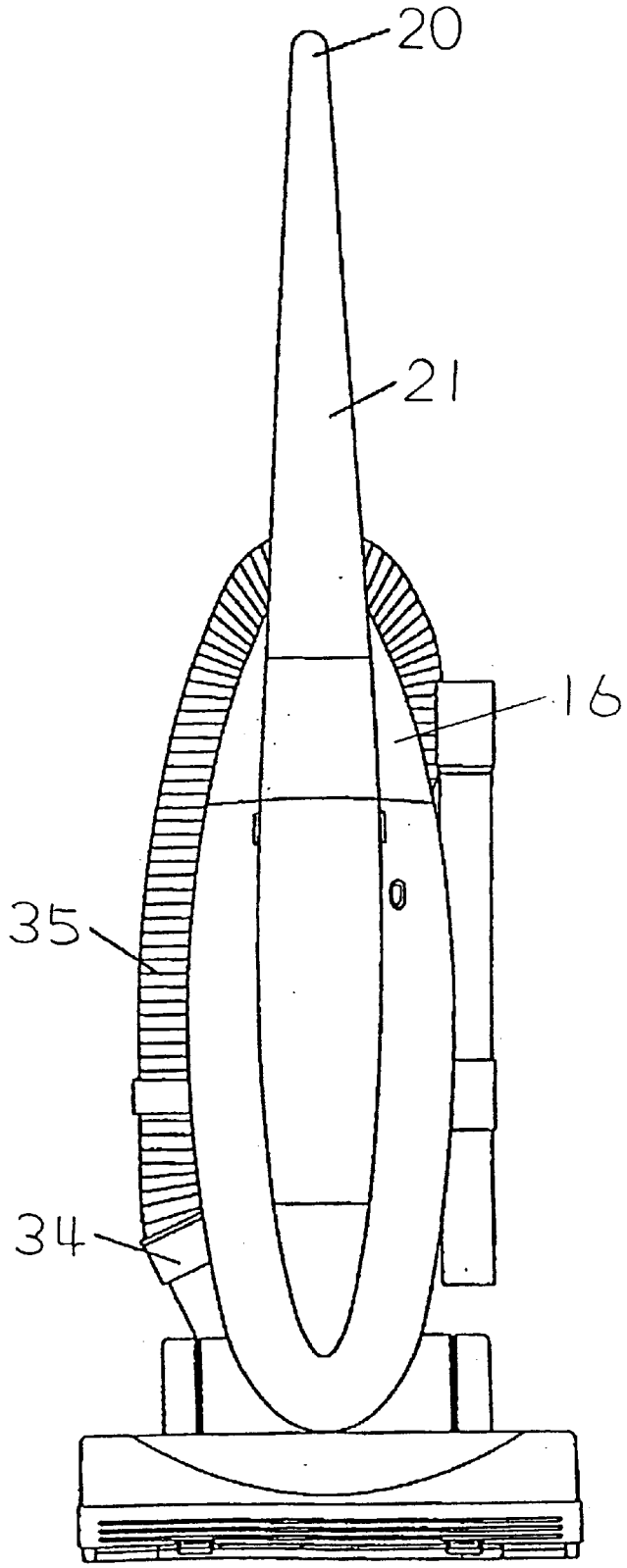
FIG. 1 is a front view of an electric vacuum cleaner in accordance with the first embodiment of the present invention.
Figure 2:
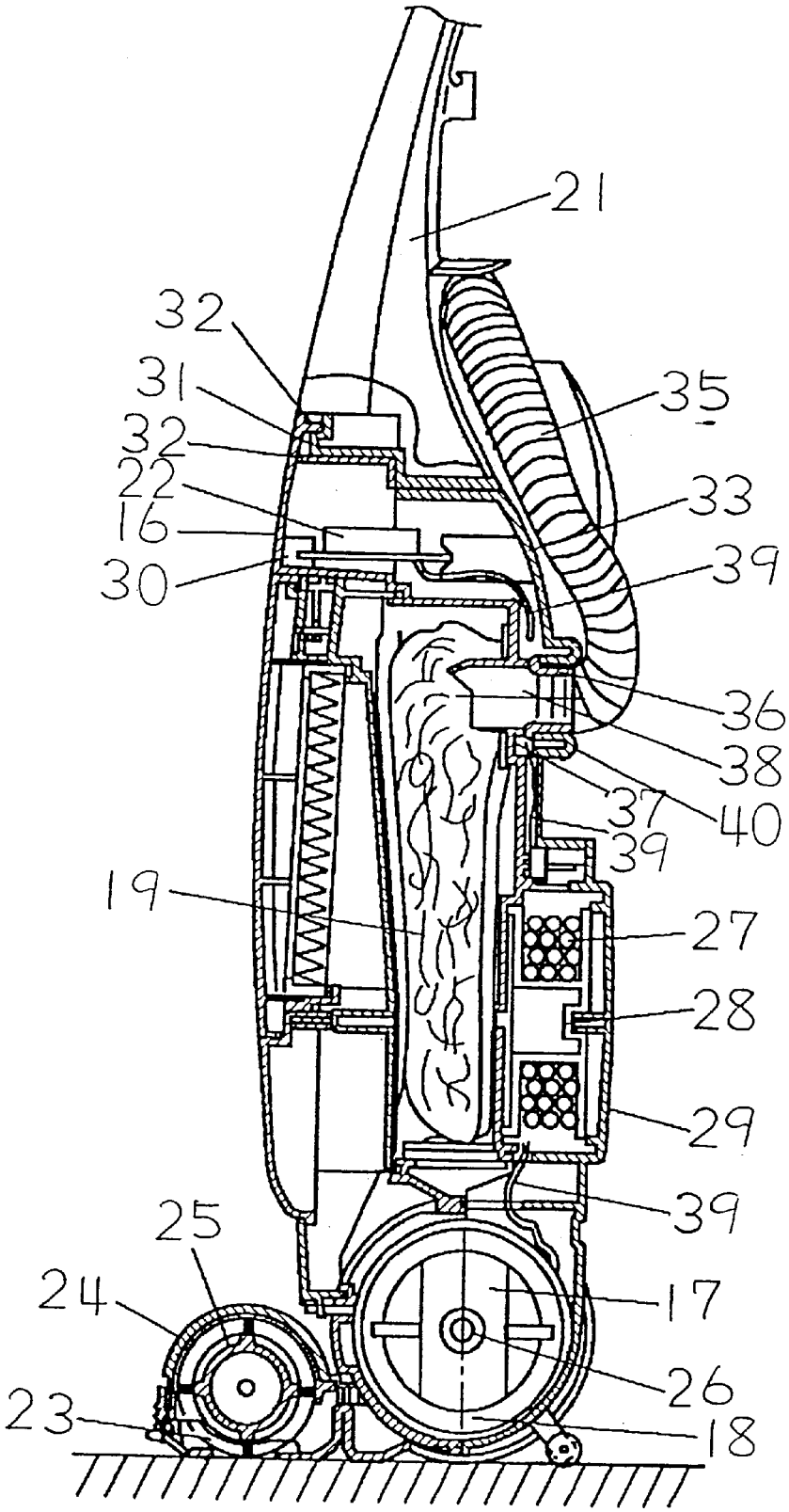
FIG. 2 is a side view of the electric vacuum cleaner with parts broken away.

As shown in FIG. 1 and FIG. 2, a cleaner main body 16 comprises a fan chamber 18 equipped with an electric fan 17 at the bottom thereof, a dust collecting chamber 19 formed above the fan chamber 18, a handle 21 having a grip portion 20 and a control circuit board 22 to control the electric fan 17, which is located above the dust collecting chamber 19.

At the bottom of cleaner main body 16 is located a suction unit 24 having a suction port 23 to take in dust or the like on the floor surface. The suction unit 24 is furnished with a rotary brush 25 to gather up dust or the like on the floor surface. The cleaner main body 16 is rotatably supported on a rotary shaft 26 in the suction unit 24.

A cord winding device 28 to store a cord 27 is located behind the dust collecting chamber 19 at the rear of the cleaner main body 16. The electric fan 17 is also disposed at the rear of cleaner main body 16 and is finally covered by a cover 29 together with the cord winding device 28, and is secured by screws or the like. The control circuit board 22 is stopped by a rib 30 provided in the cleaner main body 16, and protrusion 31 of the handle 21 is press-fitted by a guide rib 32 provided in the cleaner main body 16. A cover 33 serves to cover and secure the control circuit board 22 and handle 21.

A connection pipe 34 is connected to a hose 35 in communication with the suction port 23, and one end of same is connected to an air intake pipe 36. The air intake pipe 36 is rotatably disposed at rear portion 37 of the dust collecting chamber 19 and is connected to a connection port 38.

Figure 4:
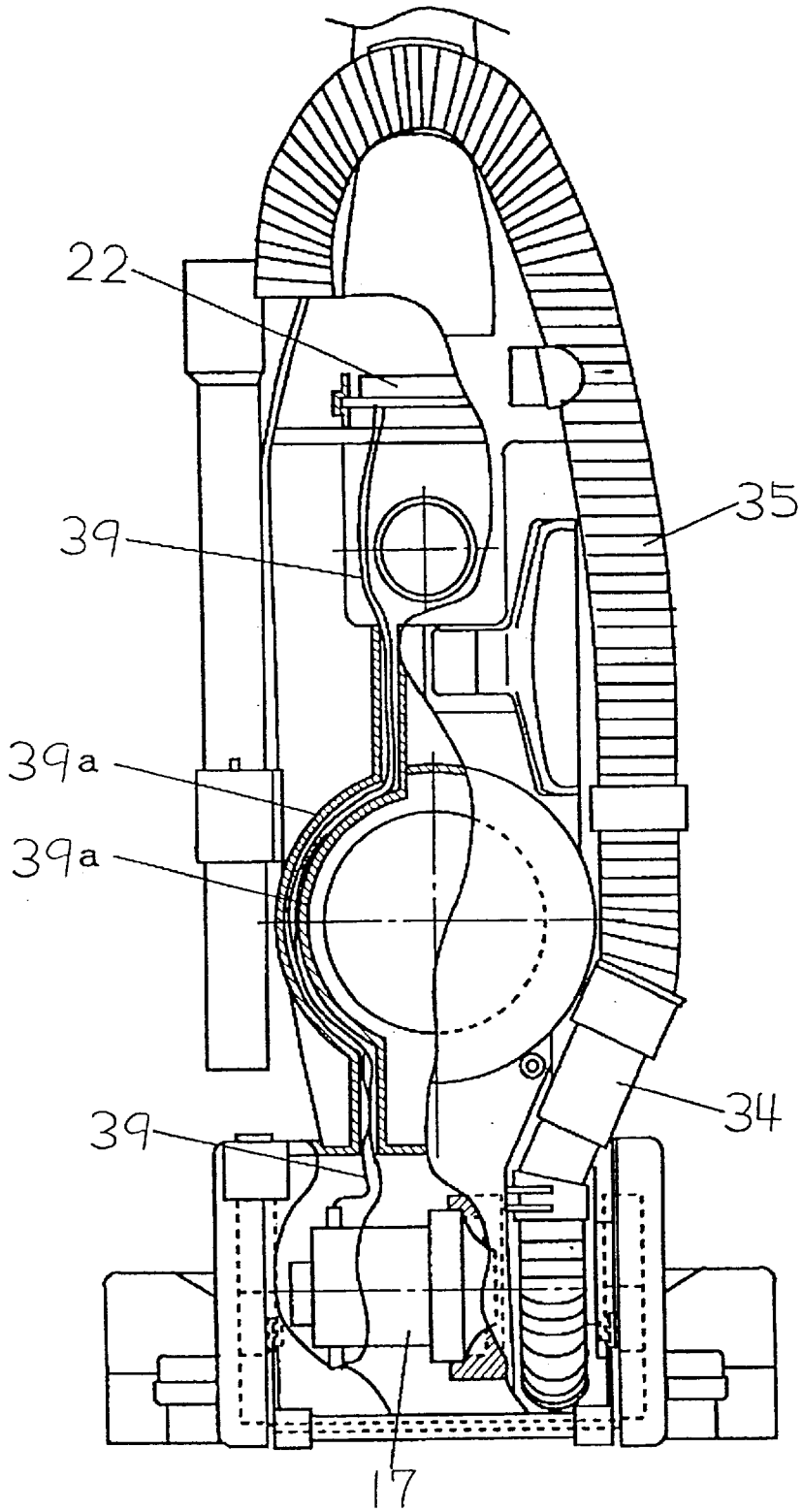
FIG. 4 is a back view of the electric vacuum cleaner with parts broken away.

Also, as shown in FIG. 2 and FIG. 4, wiring 39 from the electric fan 17 and the control circuit board 22 is tight held by circularly arcuate rib 39*a* formed between the dust collecting chamber 19, cover 29 and the cover 33 outside the dust collecting chamber 19.

Also, as shown in FIG. 2, a generally arcuate protrusion 40 is disposed at the outer periphery of the air intake pipe 36 connected to the hose 35 at the back of the cleaner main body 16.

Figure 3:
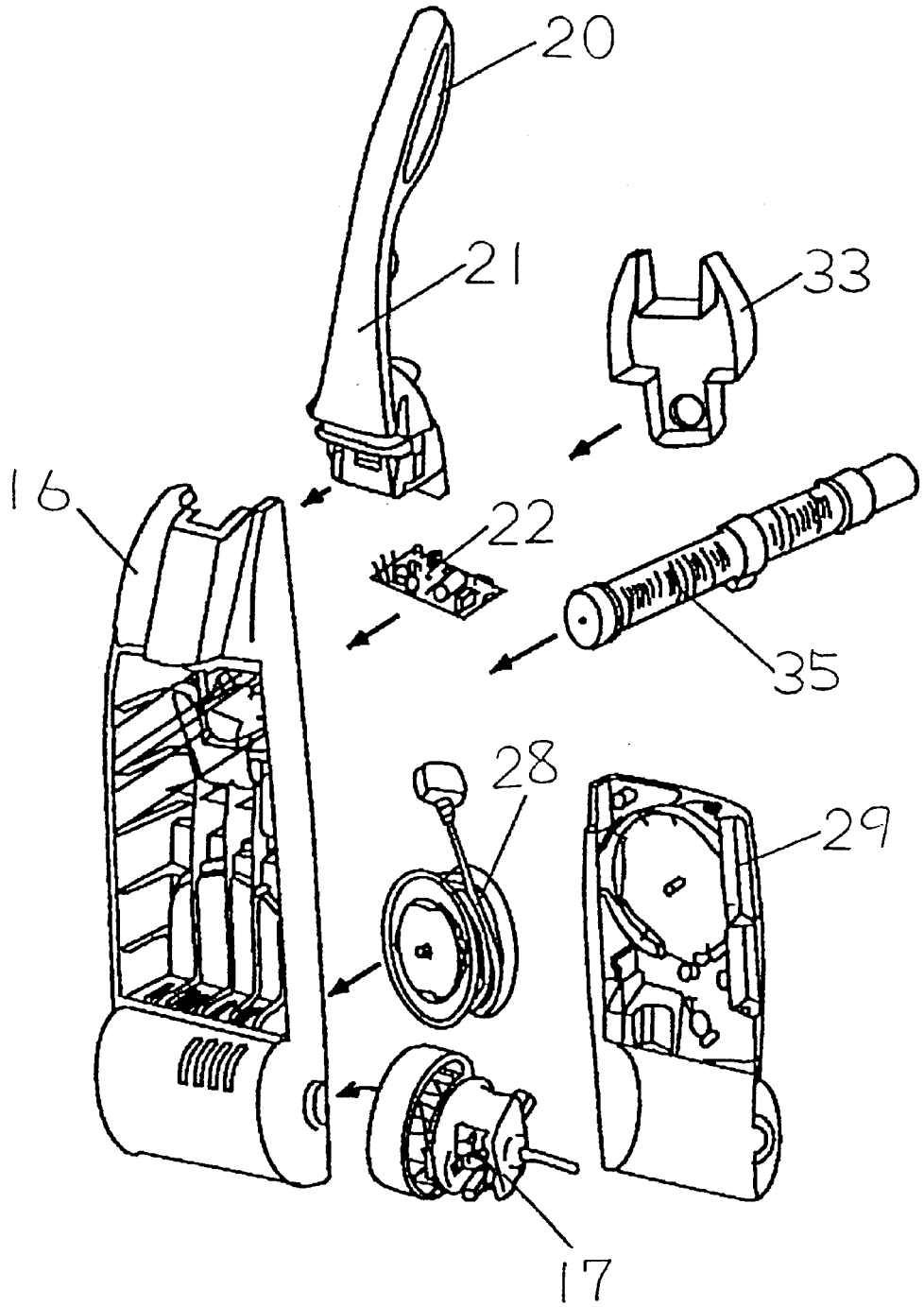
FIG. 3 is an exploded perspective view of the electric vacuum cleaner.

Actions in the above configuration will be described in the following. As shown in FIG. 3, when the cleaner main body 16 is assembled, attachments such as handle 21, control circuit board 22, electric fan 17, and cord winding device 28 are installed at the rear of cleaner main body 16. Accordingly, parts assembling can be finished only by doing the job at the rear of the cleaner main body and it is possible to shorten the time required for the assembling job and to improve the workability. Also, since two component parts such as electric fan 17 and cord winding device 28 are covered by only one cover 29, it is possible to decrease the number of component parts.

Further, the wiring 39 from the electric fan 17 and the control circuit board 22 is tightly held by the circularly arcuate rib 39*a* formed between the dust collecting chamber 19, cover 29 and the cover 33 outside the dust collecting chamber 19. Accordingly, there is no notch for the wiring 39 led into the dust collecting chamber 19, and it is possible to improve the air-tightness in the dust collecting chamber 19 and to obtain sufficient dust collecting effects. Also, it is possible to simplify the internal structure of the dust collecting chamber 19, making the die construction easier, and to lower the manufacturing cost.

Also, a generally arcuate protrusion 40 is disposed at the outer periphery of air intake pipe 36 connected to the hose 35 at the back of cleaner main body 16. Accordingly, the generally arcuate protrusion 40 may prevent the hose 35 from curving too sharp, and when the hose 35 is greatly curved, it is possible to protect the hose 35 by the generally arcuate protrusion 40, and thereby, the hose 35 is prevented from being damaged.

Next, the second embodiment of the present invention will be described in the following with reference to FIG. 5~FIG. 15.

Figure 5:
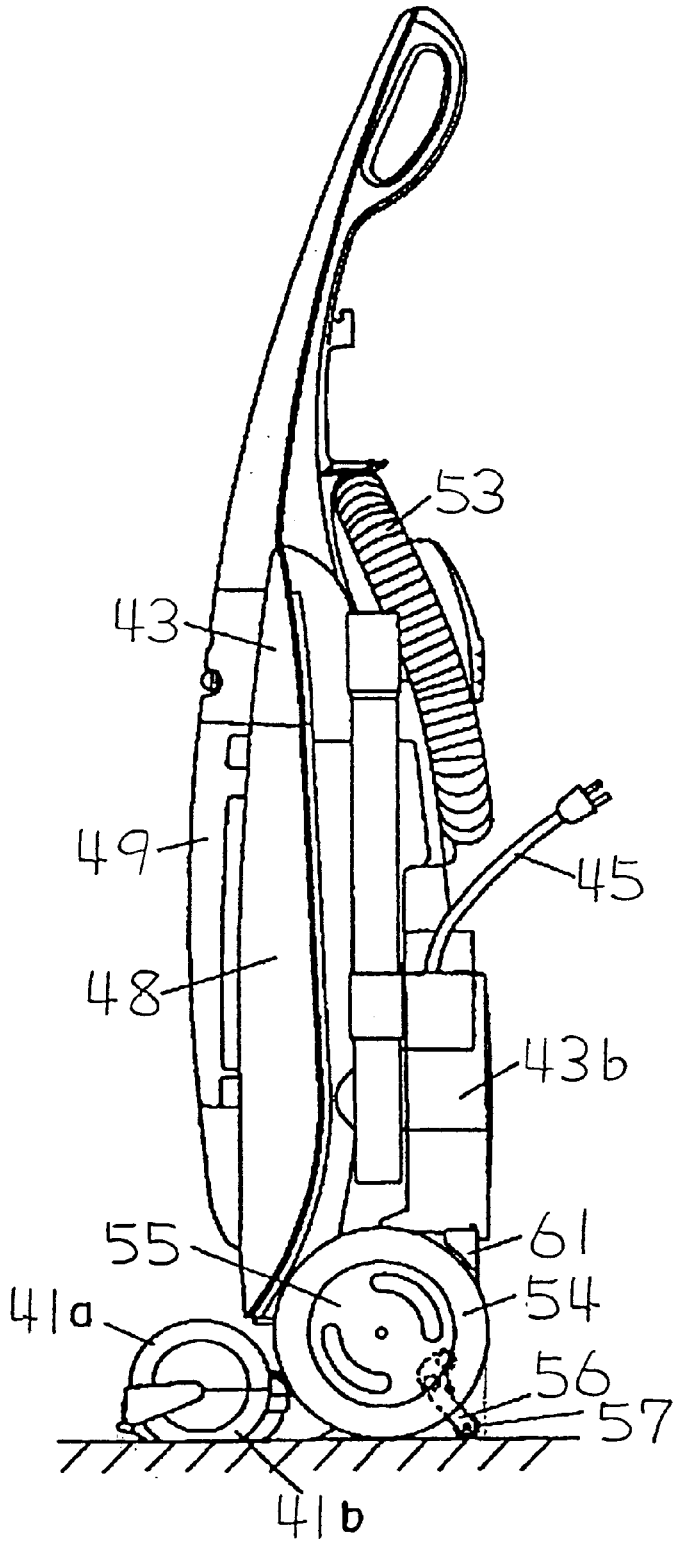
FIG. 5 is a side view of an electric vacuum cleaner in accordance with the second embodiment of the present invention.
Figure 6:
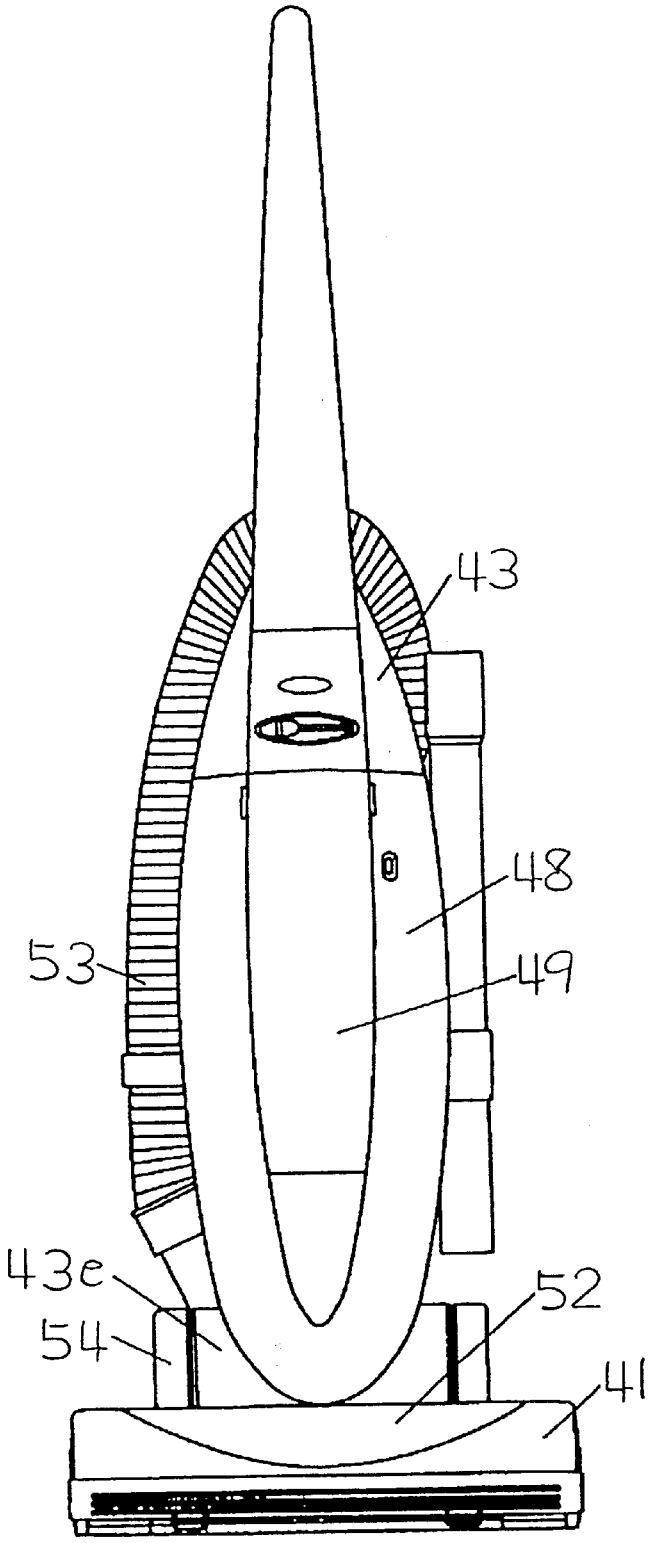
FIG. 6 is a front view of the electric vacuum cleaner.
Figure 7:
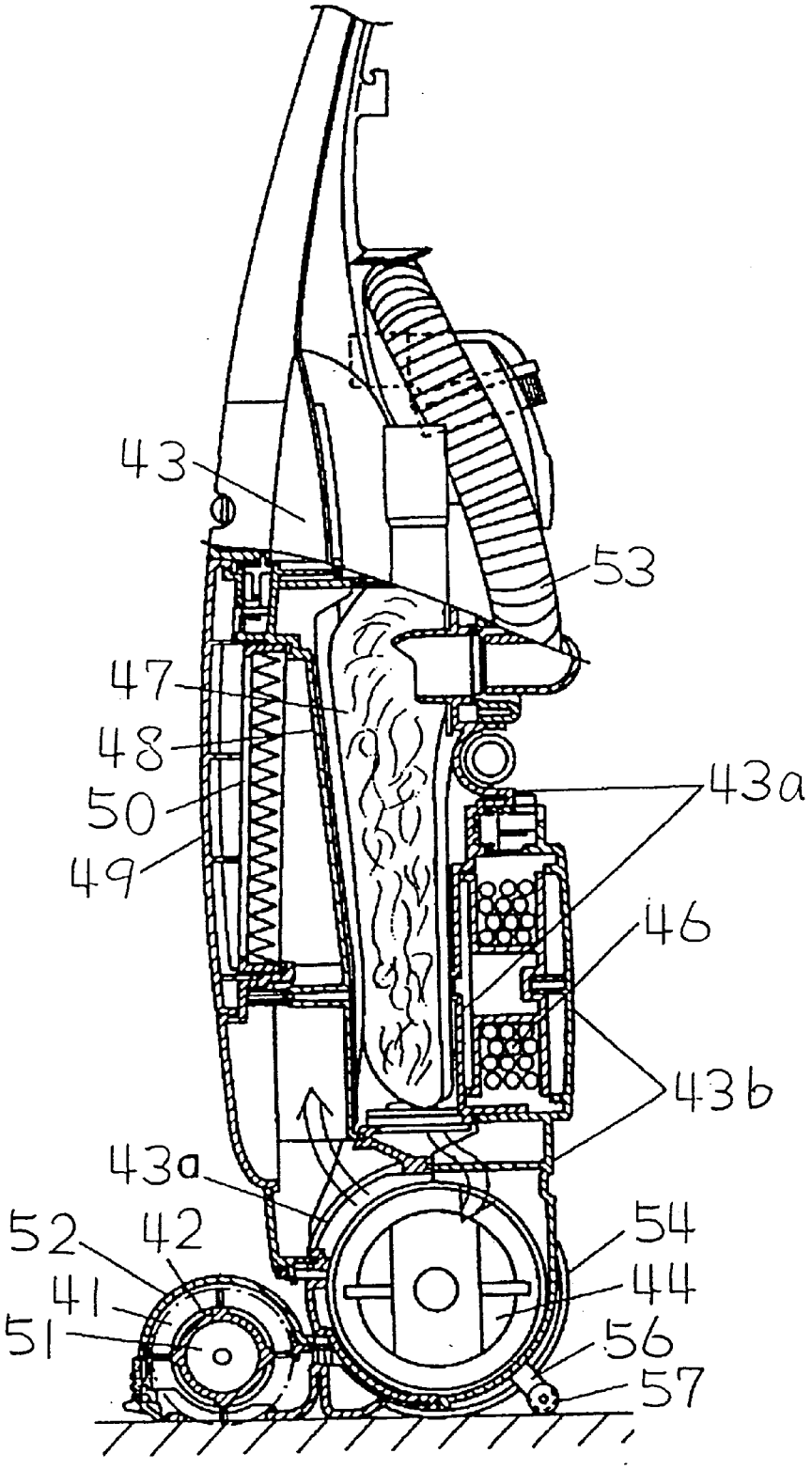
FIG. 7 is a fragmentary sectional view of the electric vacuum cleaner.

As shown in FIG. 5~FIG. 7, a suction unit 41 is equipped with a rotary brush 42 to gather up dust, and a cleaner main body 43 is disposed for universal movement on the suction unit 41. The cleaner main body 43 comprises a main body front 43*a* and a main body rear 43*b*, and an electric fan 44 to suck up dust and a cord winding device 46 to store a cord 45 are disposed therebetween. A dust bag 47 functions to collect dust. A dust collecting chamber lid 48 can be opened or closed when attaching or detaching the dust bag 47. A filter retainer 49 detachably retains an exhaust filter 50 to catch fine dust contained in the air discharged by the electric fan 44.

Figure 8:
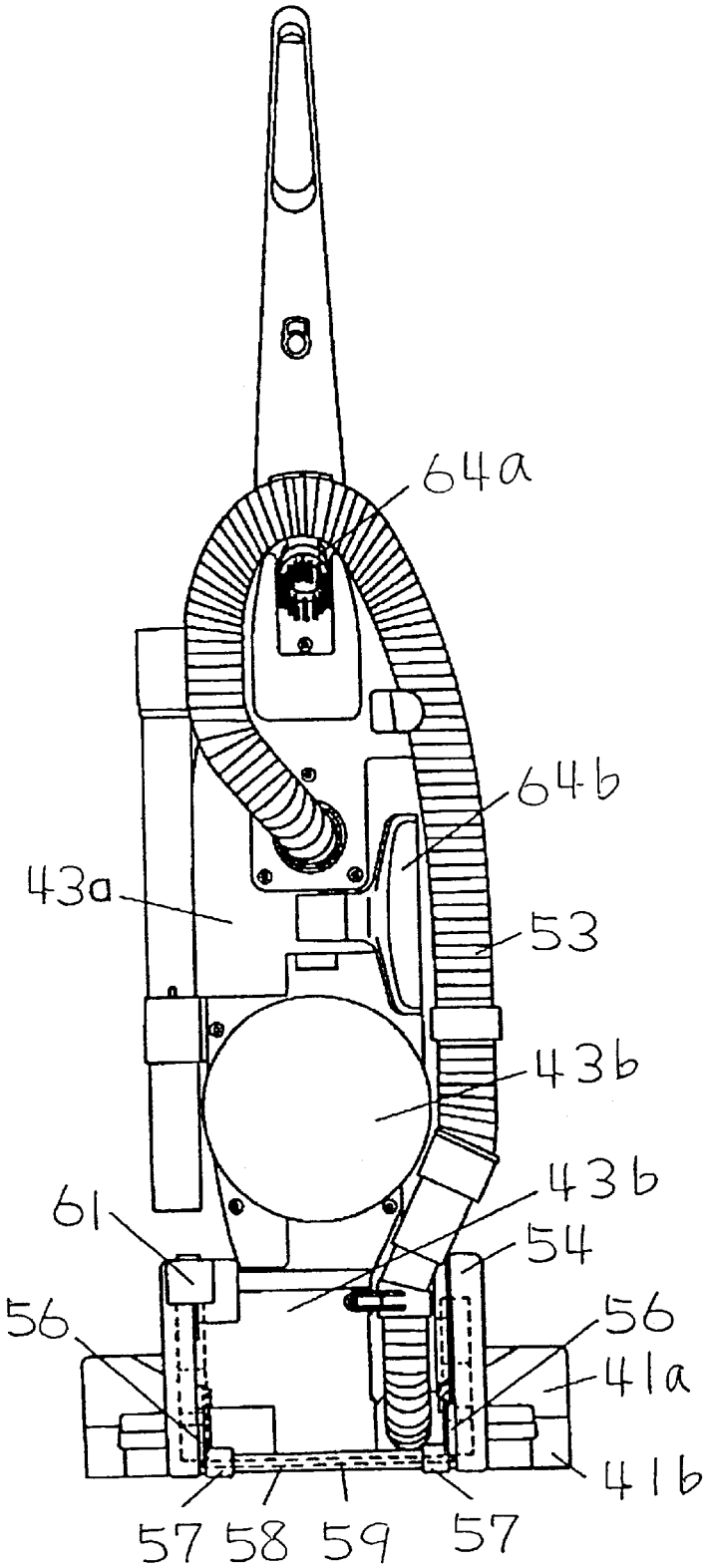
FIG. 8 is a rear view of the electric vacuum cleaner.

A rotary brush 42 is equipped with a small-sized drive motor 51, and there is provided a semi-transparent window 52 there above so that the operation of the rotary brush 42 can be checked from outside. Also, the cleaner main body 43 and the suction unit 41 are, as shown in FIG. 8, connected to each other by a detachable hose 53.

Next, as shown in FIG. 9~FIG. 12, the outer case of the suction unit 41 includes a suction unit top 41*a* and a suction unit bottom 41*b*, and at the same time, a rotary shaft 43*c* having a main body front 43*a* and a main body rear 43*b* is sandwiched between the suction unit top 41*a* and the suction unit bottom 41*b*, thereby forming a bearing portion 41*c*.

A caster roller 54 is rotatably installed on a roller mount portion 43*e* that is coaxial with a rotary shaft 43*c* located at the bottom of cleaner main body 43, and is secured by a roller retaining plate 55. The roller mount portion 43*e* is nearly identical in outer diameter with the caster roller 43, and covers the electric fan 44.

A support plate 56 includes a support portion which serves to prevent the cleaner main body 43 from falling down easily. When an action point 56*b* is pushed backwardly by cam 43*d* disposed in the main body rear 43, then a small roller retaining portion 56*c* is forced down, and at the same time, a small roller 57 rotatably disposed on the small roller retaining portion 56*c* is abutted on the floor surface. Two small rollers 57 include a spacer 58 therebetween and are rotatable on a rotary shaft 59. Also, the support plate 56 is activated upwardly by a tension spring 60.

A release pedal 61 is operated when shifting down the cleaner main body 43. The release pedal 61 is formed so as to protrude neither from the rear end nor from the front end of caster roller 54, and is abutted against the caster roller 54 when operated.

Figure 9:
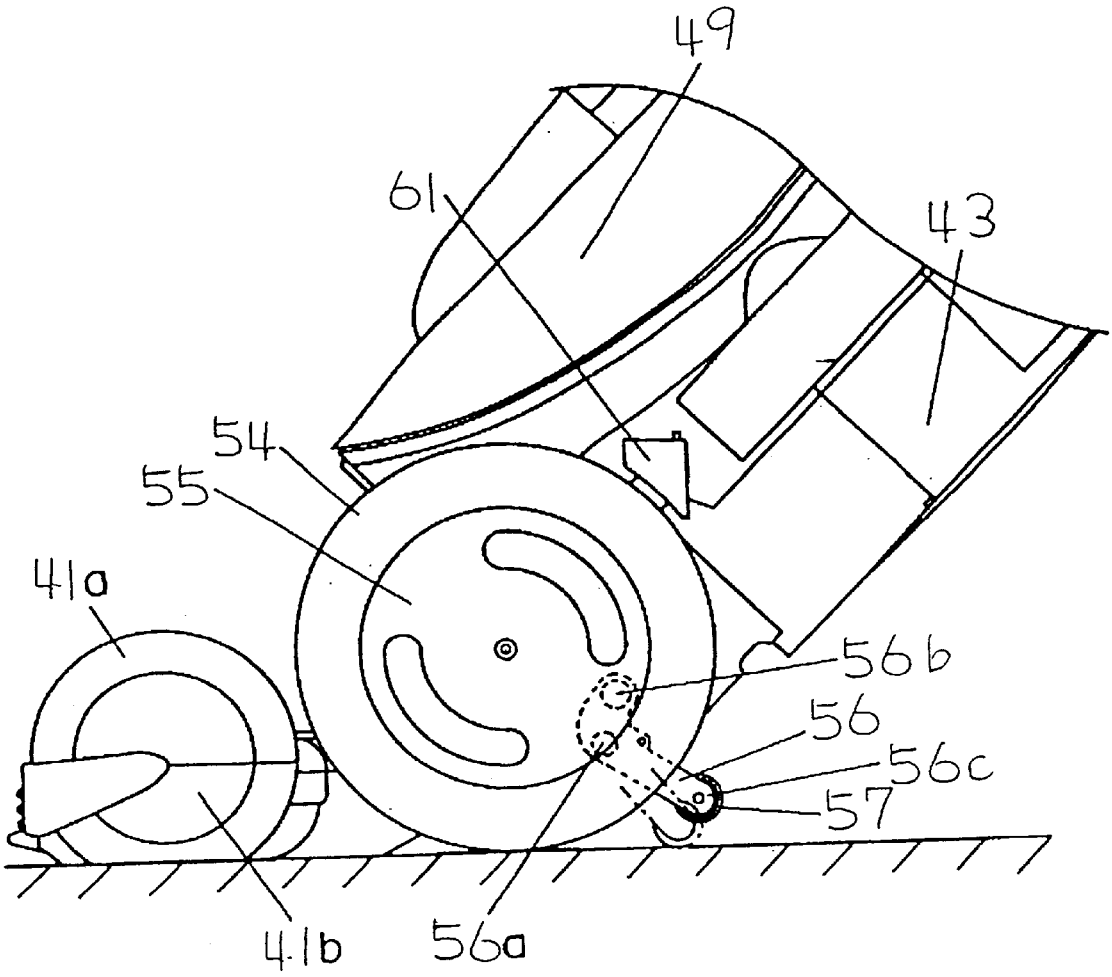
FIG. 9 is an enlarged side view of essential parts of the electric vacuum cleaner with its main body inclined.
Figure 11:
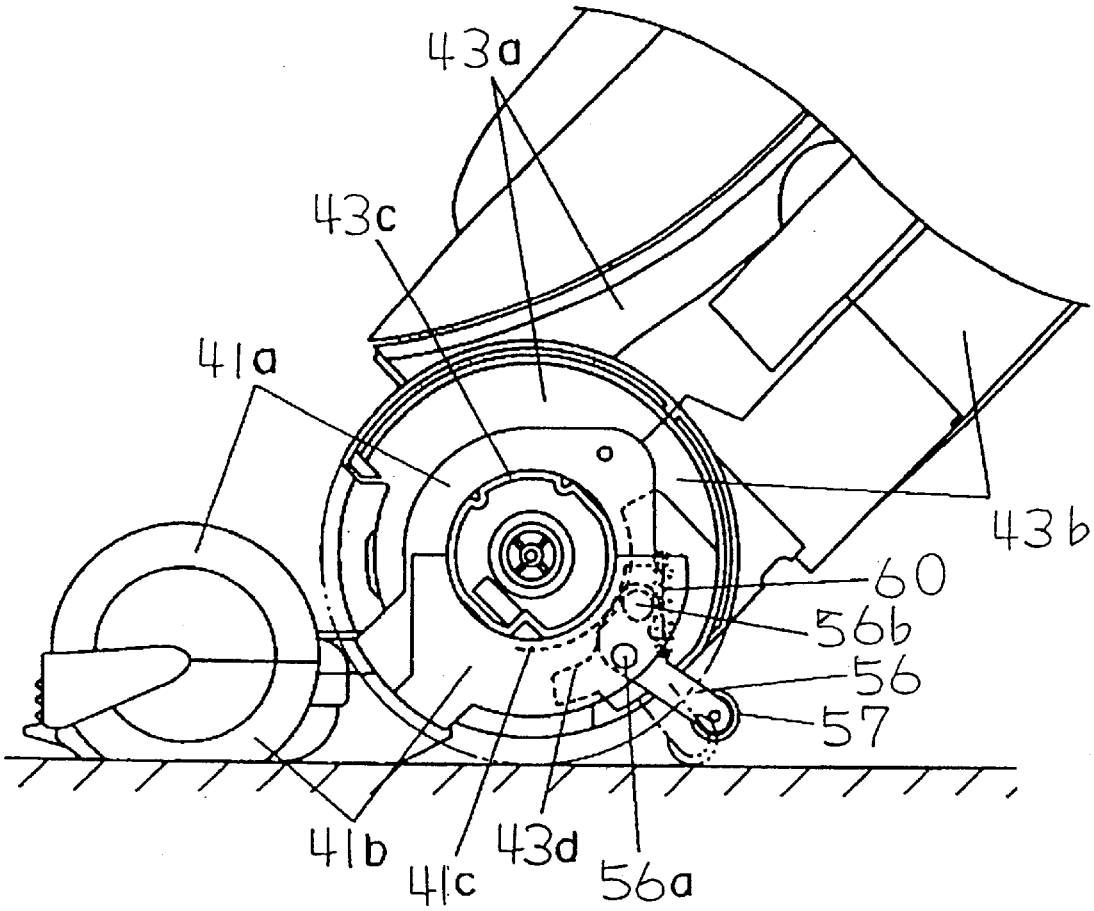
FIG. 11 is an enlarged side view of essential parts of the electric vacuum cleaner with its caster roller removed.
Figure 12:
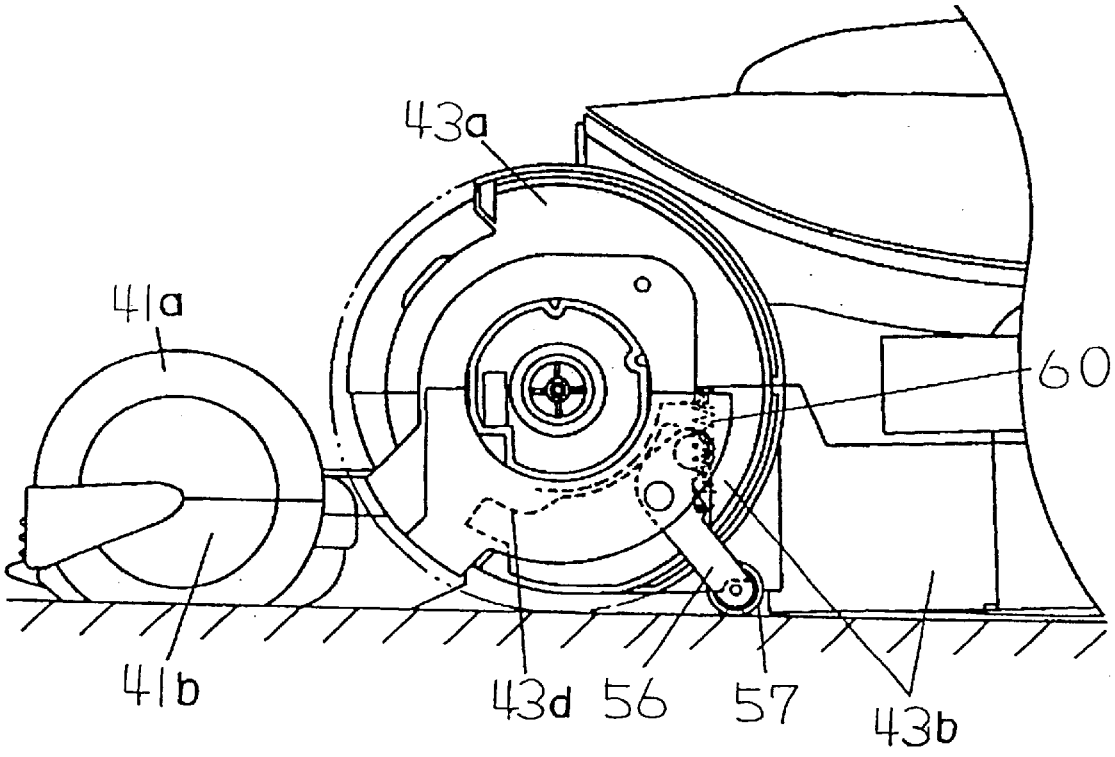
FIG. 12 is an enlarged side view of essential parts of the electric vacuum cleaner with its caster roller removed and main body kept at a generally horizontal position.

Actions in the above configuration will be described in the following. When the cleaner main body 43 is inclined in use, as shown in FIG. 9 or FIG. 11, the support plate 56 moves apart from the cam 43*d* formed at the main body rear 43*b* and is activated upwardly by the tension spring 60, and the small roller 57 moves up apart from the floor surface so that the vacuum cleaner may be operated smoothly even on a long-pile fluffy carpet or the like. Also, the suction unit 41 can be freely moved up or down as needed.

Figure 10:
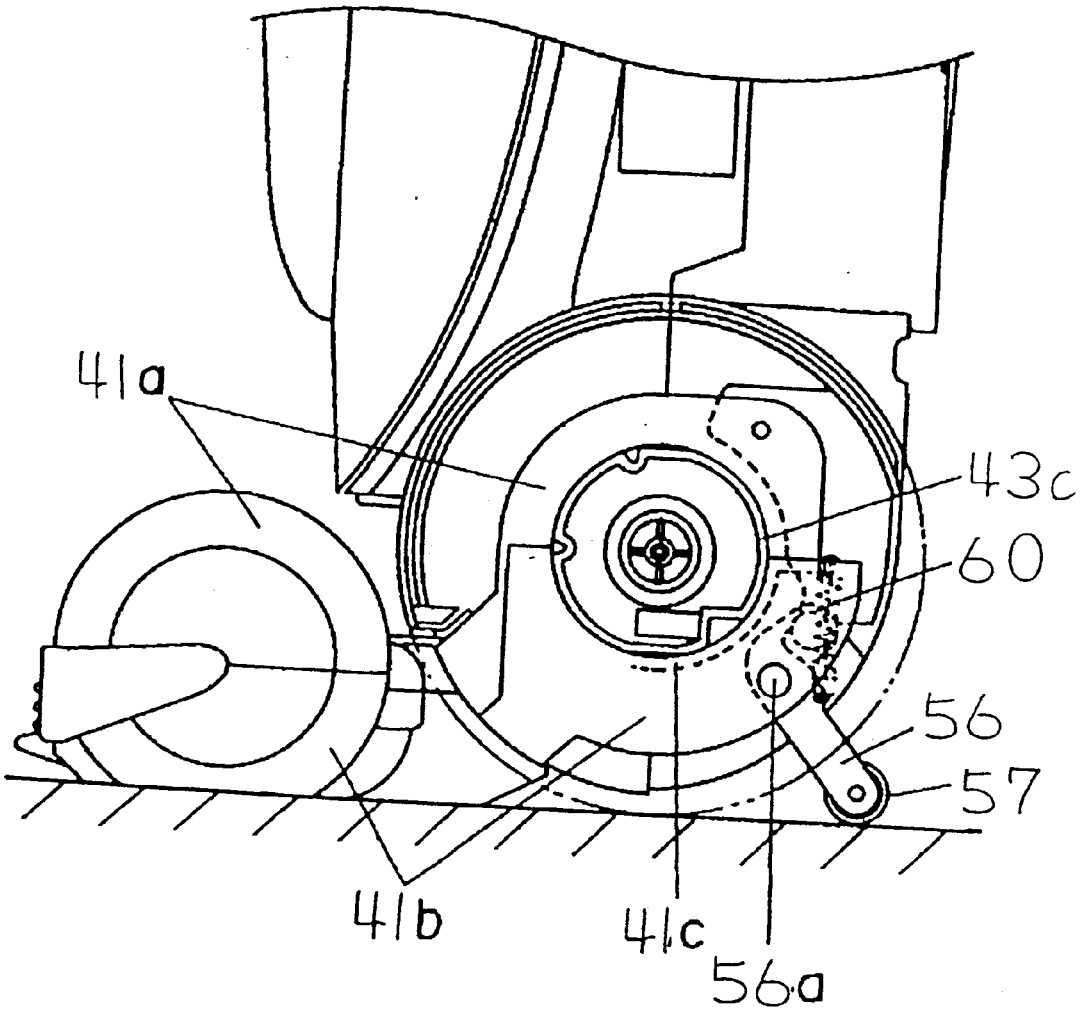
FIG. 10 is an enlarged side view of essential parts of the electric vacuum cleaner with its main body kept in an upright position.

Also, as shown in FIG. 10, when the cleaner main body 43 is set upright after using, the action point 56*b* of the support plate 56 abuts on the cam 43*d*. The support plate 56 rotates on the rotary shaft 56*a* and then the small roller 57 abuts on the floor surface to support the cleaner main body 43. Thus, it is possible to prevent the cleaner main body from falling down especially in the backward direction.

Here, the small roller 57 is rotatably disposed on the small roller retaining portion 56*c* of the support plate 56. So, as shown in FIG. 13, it is possible to smoothly move the vacuum cleaner, without dragging the suction unit 41, due to the small roller 57, with the cleaner main body 43 kept upright.

Figure 13:
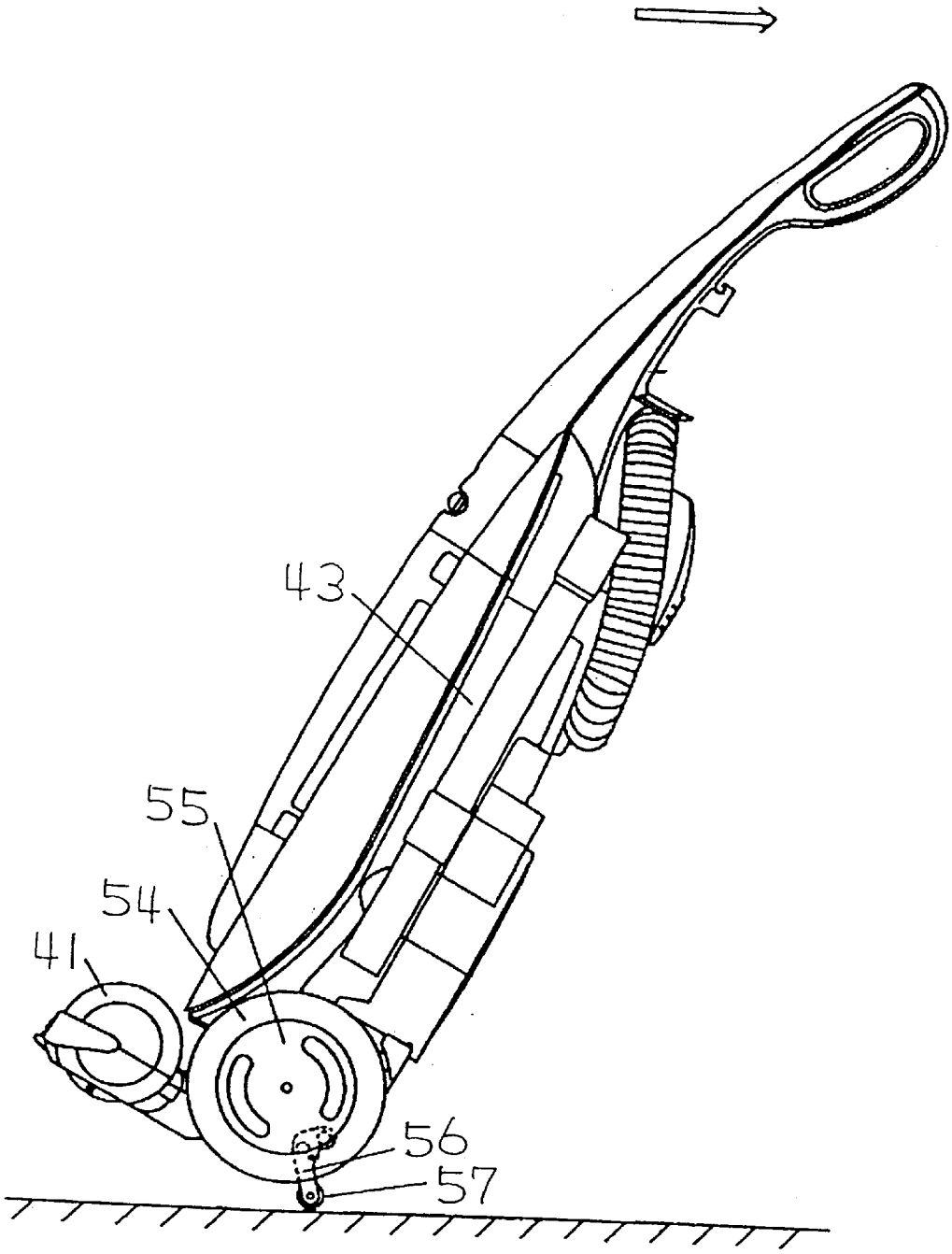
FIG. 13 is a side view showing a state of the electric vacuum cleaner in operation.
Figure 14:
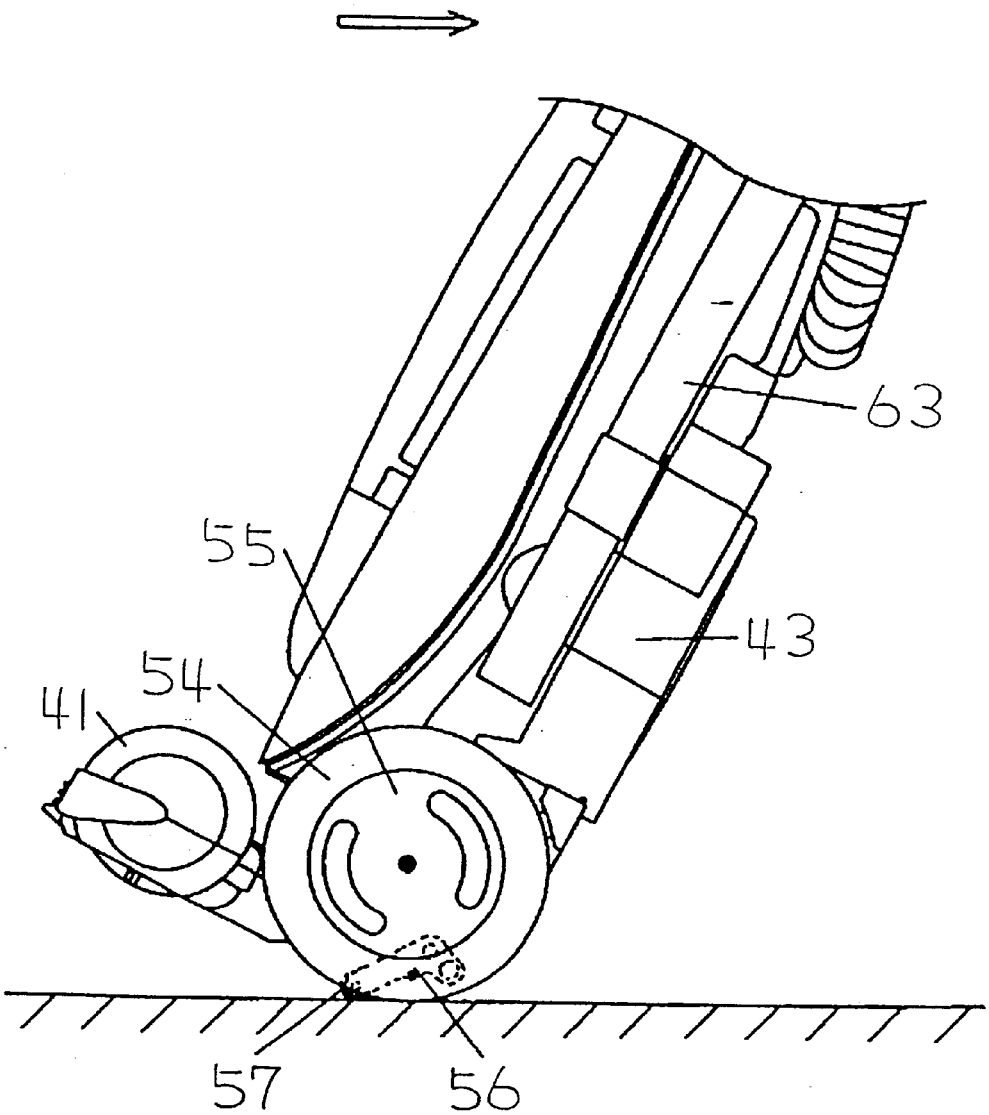
FIG. 14 is an enlarged side view of essential parts, showing a state of the electric vacuum cleaner in operation.

Also, when moving the vacuum cleaner in a state of FIG. 13, if the support plate 56 and the small roller 57 are given strong shocks due to an undulated floor surface or the like, then the support plate 56, which is freely movable in the forward direction, as shown in FIG. 14, will be shifted to the opposite side, causing the caster roller 54 to take over the role, and thereby, it is possible to prevent the support plate 56 and the small roller 57 from damage or the like.

Figure 15:
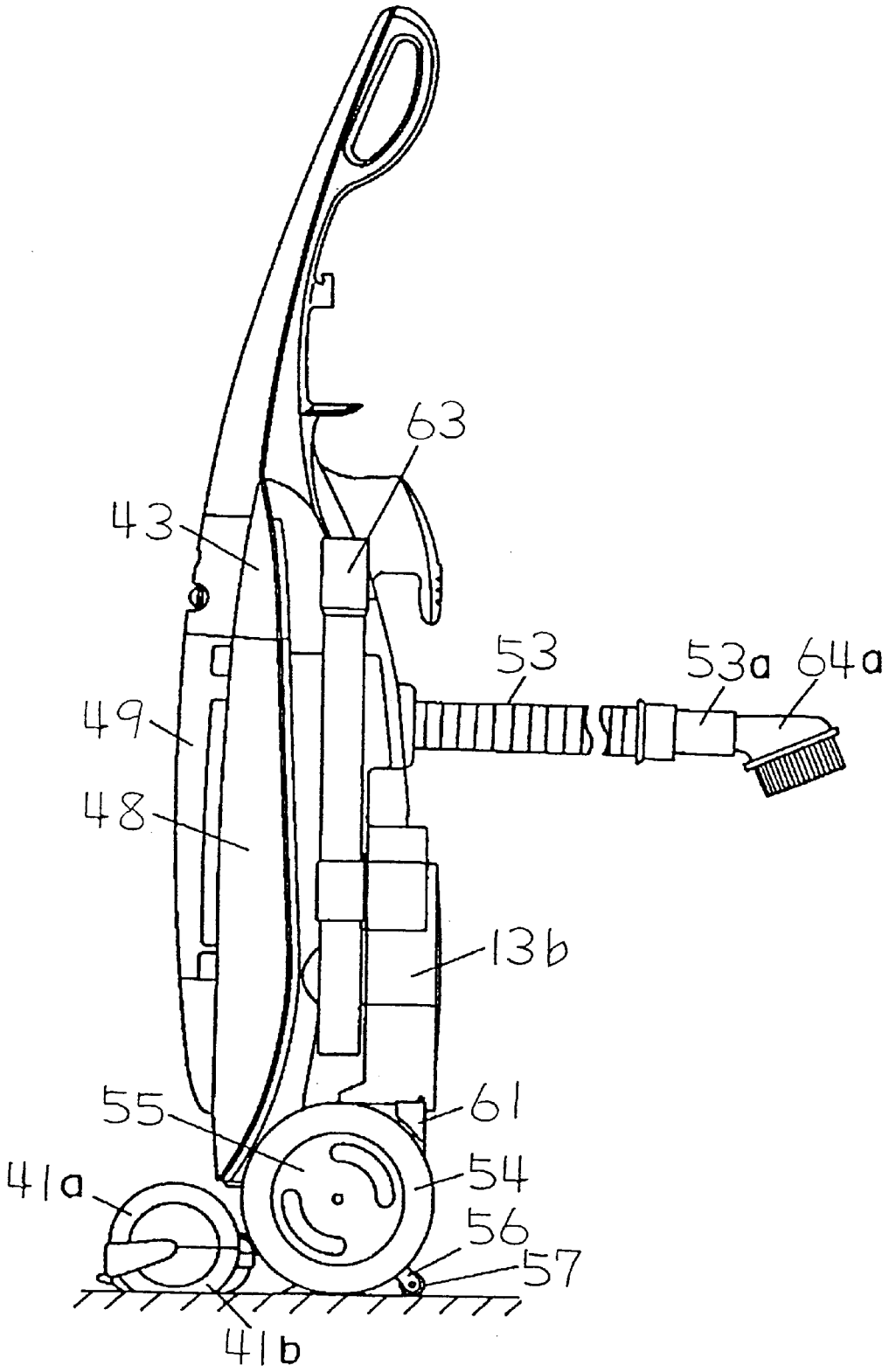
FIG. 15 is a side view showing a state of the electric vacuum cleaner with attachments fitted thereto.

Further, as shown in FIG. 15, with the cleaner main body 43 kept upright, connecting portion 53*a* of the hose 53 is disconnected from the suction unit 41, and attachment nozzle 64*a*, 64*b* (see FIG. 8) is connected to the connecting portion 53*a* of the hose 53 directly or via extension pipe 63. In case of cleaning a sofa, furniture or the like, even when the hose 53 is pulled backwardly at the back of cleaner main body 43, the cleaner main body 43 will not fall down because the support plate 56 abuts on the floor surface to support the cleaner main body 43, and it is easier to carry out the cleaning job.

In this configuration, the support plate 56, which is retractably or rotatably disposed in order to make the cleaner main body 43 hard to fall down in an upright position, becomes nearly abutted on the floor surface only when the cleaner main body 43 is set upright, due to the cam 43*d* formed in a part of the cleaner main body 43. Further, the configuration is such that the abutment on the floor surface of the support plate 56 is outside the plane projected on the floor surface by the caster roller 54 and the front end portion of the suction unit 41. Accordingly, when the cleaner main body 43 is set upright after using, the support plate 56 is automatically abutted on the floor surface due to the cam 43*d*, thereby preventing the cleaner main body 43 from falling down. Thus, the user is not necessary to operate a handle or any other mechanism to prevent the cleaner main body 43 from falling down. So, it is possible to improve the usability and the design convenience including the handle.

Also, since the small roller 57 is rotatably disposed in the small roller retaining portion 56*c* of the support plate 56, the cleaner main body 43 may be freely moved in an upright position, that is, keeping the suction unit 41 and the cleaner main body 43 nearly at an angle of 90°.

Further, with the cleaner main body 43 inclined in a state of using, the support plate 56 is activated by a spring or the like in a direction opposite to the floor surface so as to move the support plate apart by a specific distance from the floor surface. Accordingly, it is possible to prevent worsening of the workability, for example, due to a long-pile fluffy carpet or the like entangled in the support plate 56 during normal use of the vacuum cleaner. Also, when cleaning a lower back place such as under a bed, holding the cleaner main body 43 horizontally at nearly 180°, the support plate 56 will not limit the angle, for example by touching against the rear portion of the cleaner main body 43, and it is possible to assure same usability as is obtained with a conventional electric vacuum cleaner without such support plate 56.

Also, with the cleaner main body 43 set upright, the support plate 56 is retractably or rotatably formed in the direction of suction unit 41. So, when the cleaner main body 43 is moved, with the cleaner main body 43 kept upright, causing a strong shock to the support plate 56 due to an undulated floor surface or the like, the support plate 56 is turned and retracted in the direction of the suction unit 41, thereby preventing the support plate 56 and the small roller 57 from damage or the like.

Further, with the cleaner main body 43 inclined in a state of using, the support plate 56 is moved by a specific distance from the floor surface by the cam 43*d* provided in the cleaner main body 43. So, it is unnecessary to use a spring or the like to activate the support plate 56 in a direction opposite to the floor surface, and consequently, it is possible to lower the cost.

Also, with the cleaner main body 43 set upright, the hose 53 is connected to the cleaner main body 43, at the side where the support plate 56 abuts on the floor surface. So, when the vacuum cleaner is used, disconnecting the hose 53 from the suction unit 41 and connecting the removed hose 53 to an extension pipe or fitting an attachment to the end thereof, the support plate 56 abuts on the floor surface to support the cleaner main body 43, thereby preventing the cleaner main body 43 from falling down.

Further, the caster roller 54 is rotatably disposed on the roller mount portion 43*e* provided at the bottom of the cleaner main body 43, and the outer diameter of roller mount portion 43*e* is nearly identical with the outer diameter of caster roller 54. Accordingly, when cleaning a low back plate such as under a bed or a desk, it is possible to lessen the effects of catching or shocks caused by obstructions and to make the vacuum cleaner operation smooth and stable.

Also, a release pedal 61 is disposed, in which the release pedal 61 is operated when the cleaner main body 43 is inclining. The release pedal 61 is formed so as to protrude neither from the rear end nor from the top end of the caster roller 54. Accordingly, the release pedal does not touch furniture or the like during cleaning and it is possible to smoothly perform the cleaning job without giving damage to furniture or the like.

Also, when the release pedal 61 is operated, the release pedal 61 abuts on the caster roller 54. So, when the cleaner main body 43 is inclined by stepping on the release pedal 61, the release pedal 61 touches the caster roller 54, making it unable to rotate. Then, the cleaner main body 43 does not move so that the release pedal may be precisely depressed, thereby improving the workability.

Further, the roller mount portion 43*e* covers the electric fan 44. So, it is possible to reduce the widthwise dimension of the cleaner main body 43, and as a result, to make the vacuum cleaner smaller in size and more compact.

Next, the third embodiment of the present invention will be described with reference to FIG. 16 and FIG. 17. In this embodiment, tension spring 60 used in the second embodiment is not necessary, and the cam used is different in shape from the one used in the second embodiment.

Figure 16:
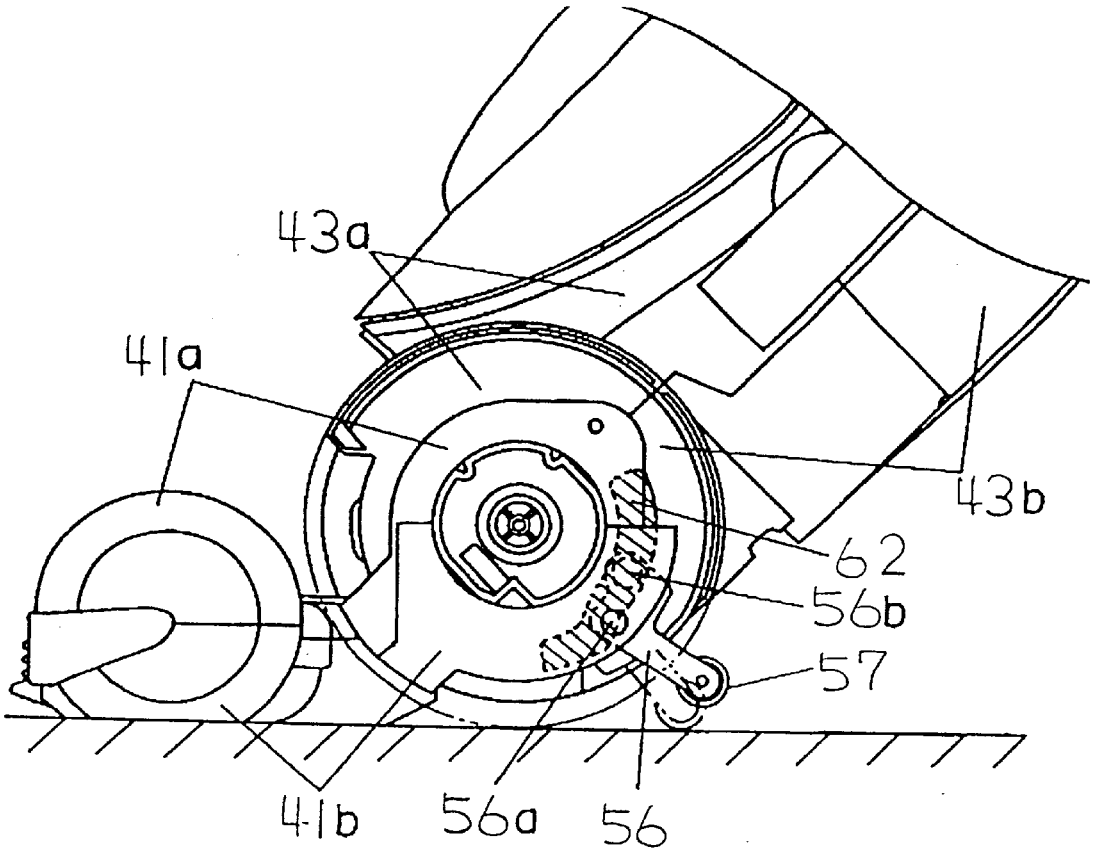
FIG. 16 is a side view of essential parts of an electric vacuum cleaner in use of the third embodiment of the present invention, with its caster roller removed.
Figure 17:
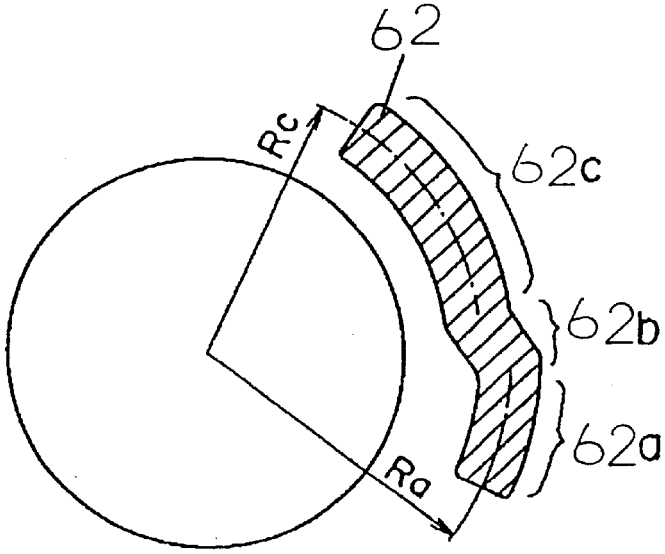
FIG. 17 is an enlarged view of a cam of the electric vacuum cleaner.
Figure 18:
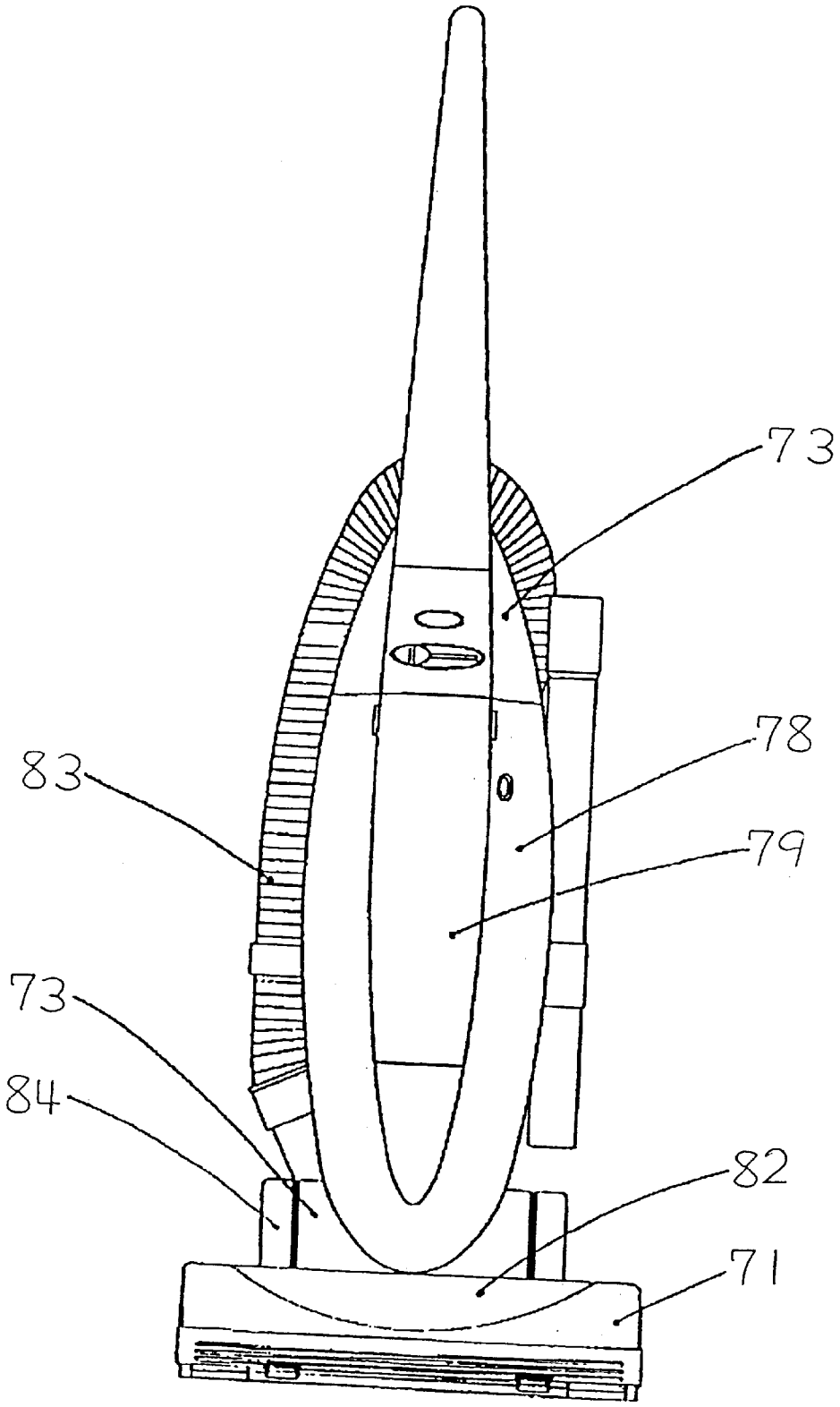
FIG. 18 is a front view of an electric vacuum cleaner in accordance with the fourth embodiment of the present invention.
Figure 19:
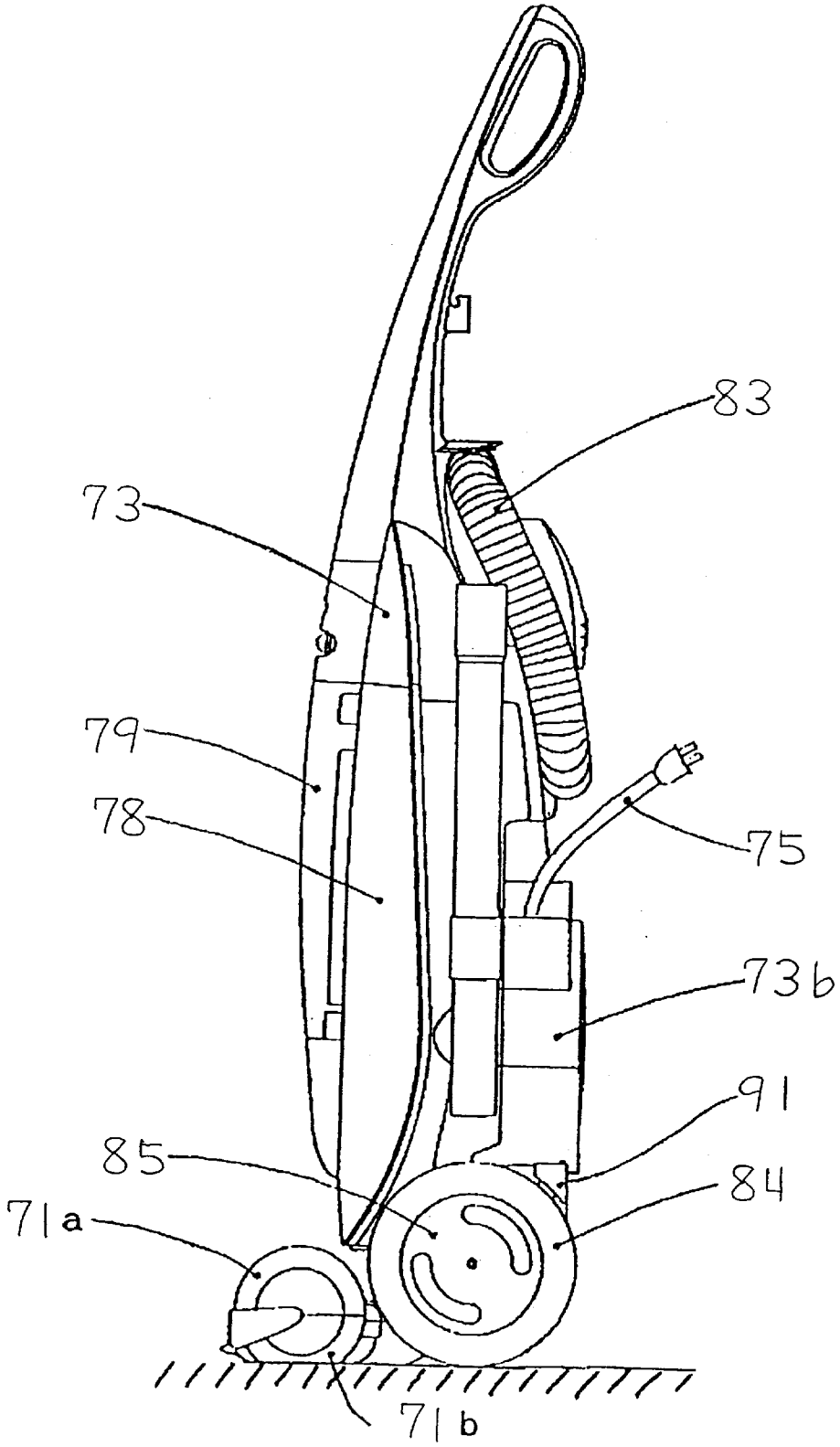
FIG. 19 is a side view of the electric vacuum cleaner.
Figure 20:
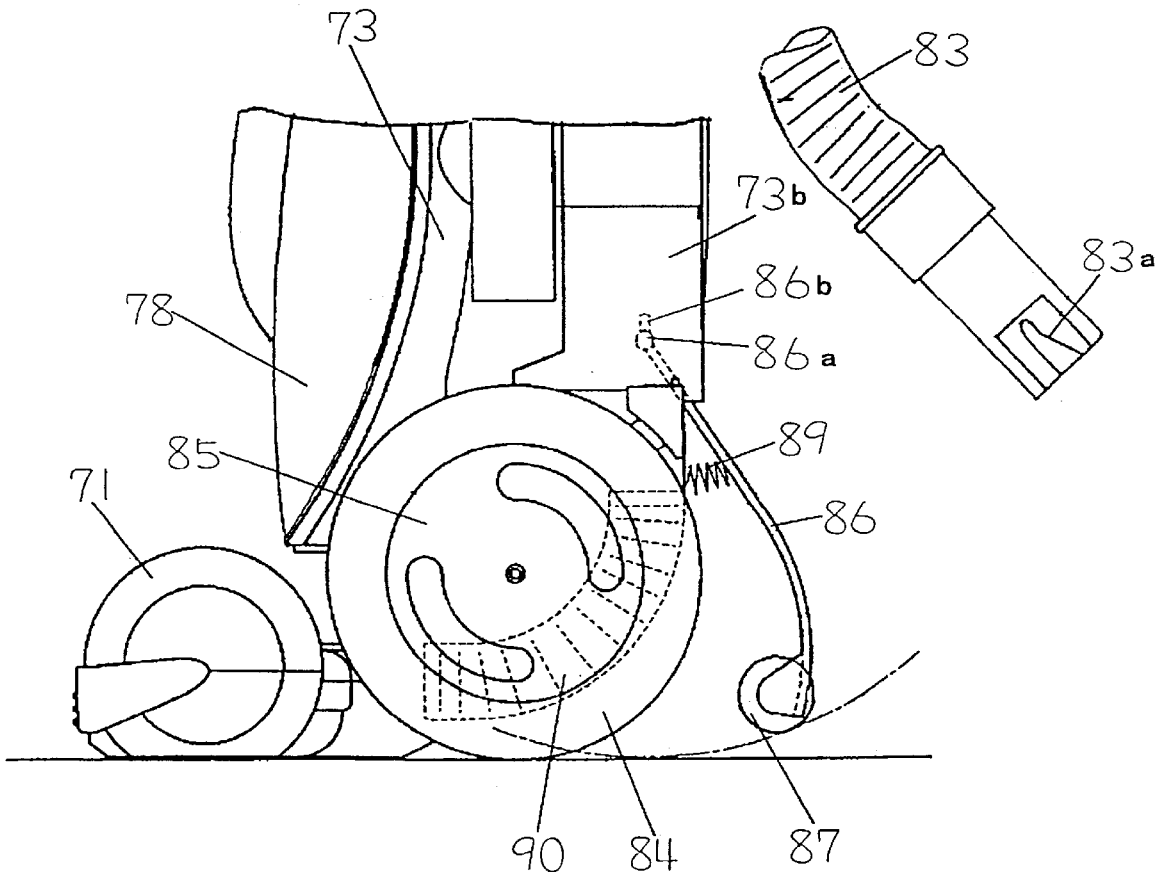
FIG. 20 is an enlarged side view of essential parts of the electric vacuum cleaner.
Figure 21:
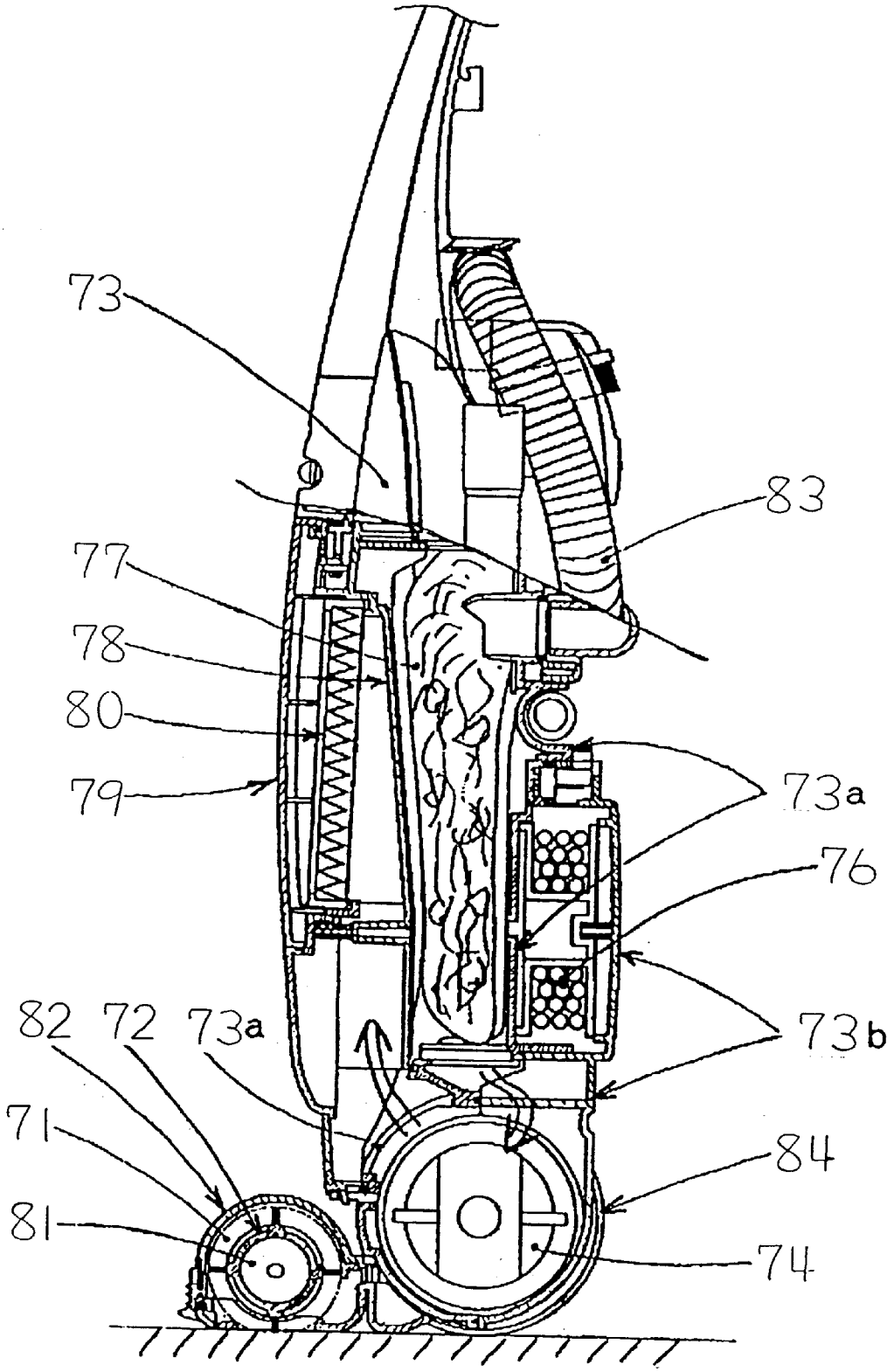
FIG. 21 is a fragmentary sectional view of the electric vacuum cleaner.

As shown in FIG. 16 and FIG. 17, a cam (shaded portion) 62 has a groove-like shape so that an action point 56*b* of support plate 56 may get in the groove. The cam 62 includes a fixing cam 62*a* that is a little wider than the action point 56*b* and serves to make a small roller 57 abut on the floor surface, a lifting cam 62*c* that serves to lift the small roller 57 off the floor surface, and a junction 62*b* that connects the cams to each other. The radius Rc of the lifting cam 62*c* is smaller than the radius Ra of the fixing cam 62*a*.

Actions in the above configuration will be described in the following. Even in case of installing no tension spring 60, when the cleaner main body 43 is inclined in use, the small roller 57 is off the floor surface since the action point 56*b* is at the position of the lifting cam 62*c*, and thereby it is possible to obtain at a low cost the same effects as in the second embodiment.

The fourth embodiment of the present invention will be described in the following with reference to FIG. 18~FIG. 25.

As shown in FIG. 18~FIG. 21, a suction unit 71 is furnished with a rotary brush 72 to gather up dust, and the suction unit 71 is disposed for universal movement in cleaner main body 73. The cleaner main body 73 comprises main a body front 73*a* and a main body rear 73*b*, and an electric fan 74 to suck up dust and a cord winding device 76 to store a cord 75 are disposed therebetween. A dust bag 77 functions to collect dust. A dust collecting chamber lid 78 can be opened or closed when attaching or detaching the dust bag 77. A filter retainer 79 detachably retains an exhaust filter 80 to catch fine dust contained in the air discharged by the electric fan 74.

Figure 22:
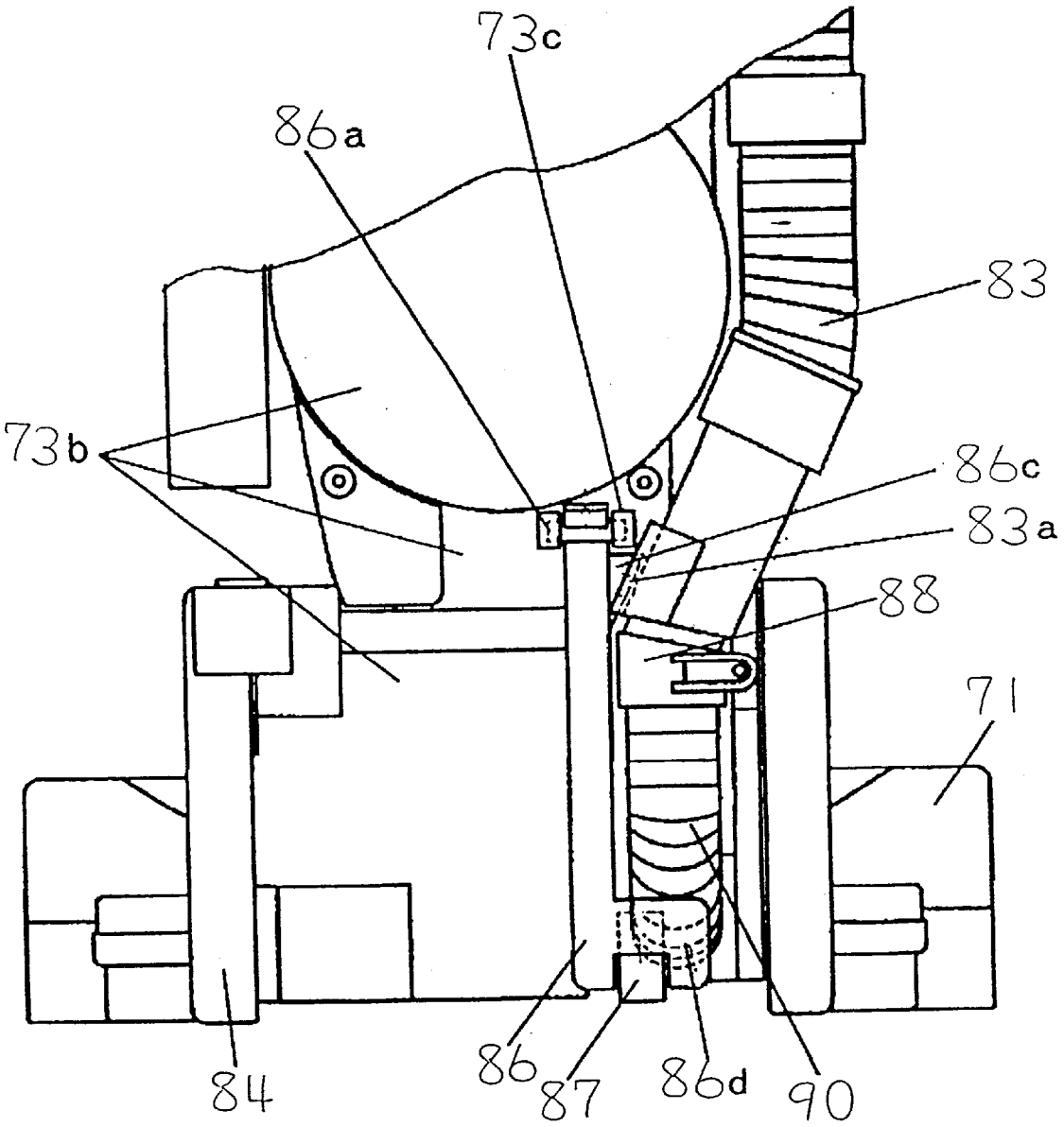
FIG. 22 is an enlarged rear view of essential parts of the electric vacuum cleaner.

A rotary brush 72 is equipped with a small-sized drive motor 81, and there is provided a semi-transparent window 82 there above so that the operation of the rotary brush 72 can be checked from outside. Also, the cleaner main body 73 and the suction unit 71 are, as shown in FIG. 22, connected to hose fixing portion 88 provided in the suction unit 71 by a detachable hose 83.

The outer case of the suction unit 71 includes a suction unit top 71*a* and a suction unit bottom 71*b*, and at the same time, a rotary shaft 73*c* having a main body front 73*a* and a main body rear 73*b* is sandwiched between the suction unit top 71*a* and the suction unit bottom 71*b*. The cleaner main body 73 is disposed for universal movement in connection with the suction unit 71.

A caster roller 84 is coaxial with the rotary shaft of the cleaner main body 73 and is disposed at the main body front 73*a*, and is rotatably retained by a roller retaining plate 85.

Figure 23:
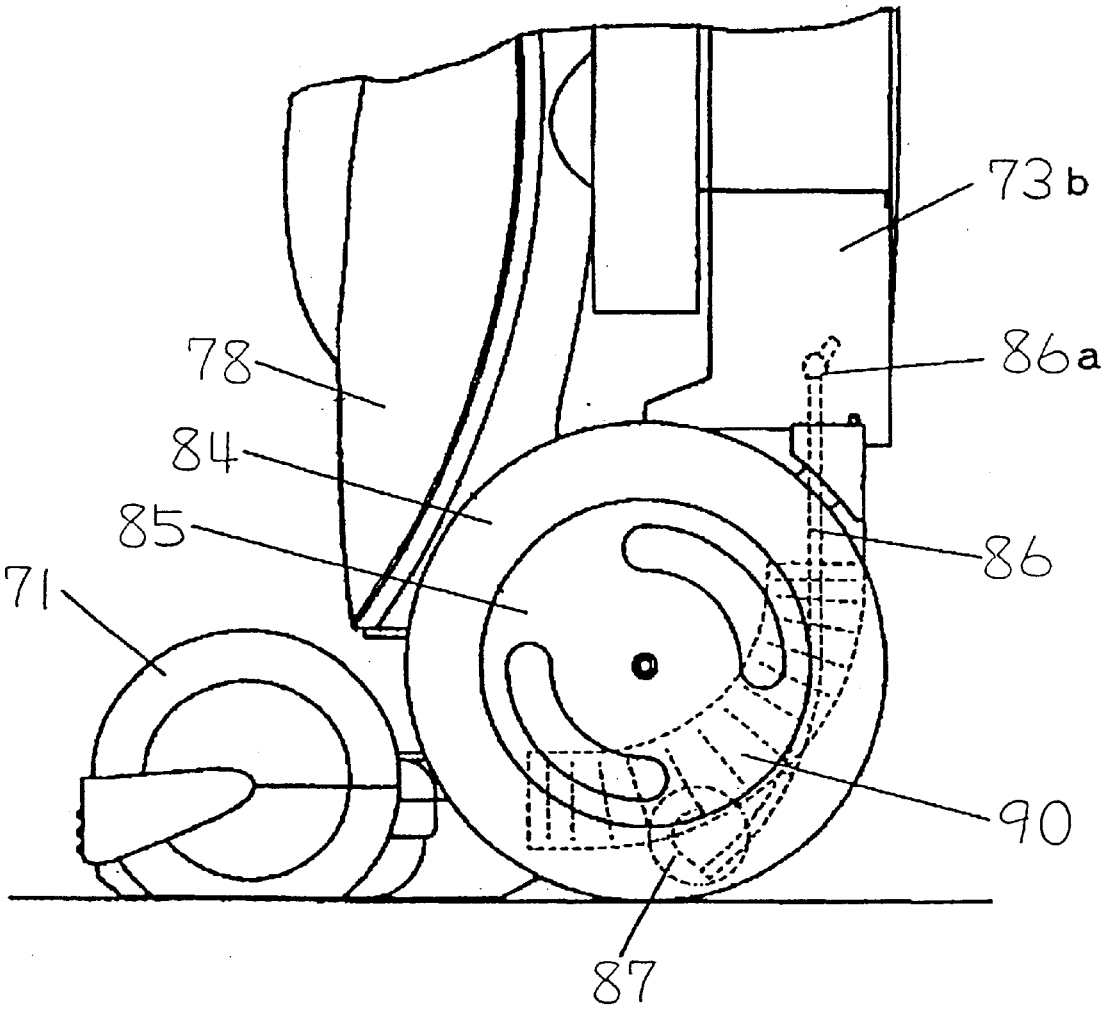
FIG. 23 is an enlarged side view of essential parts of the electric vacuum cleaner.
Figure 24:
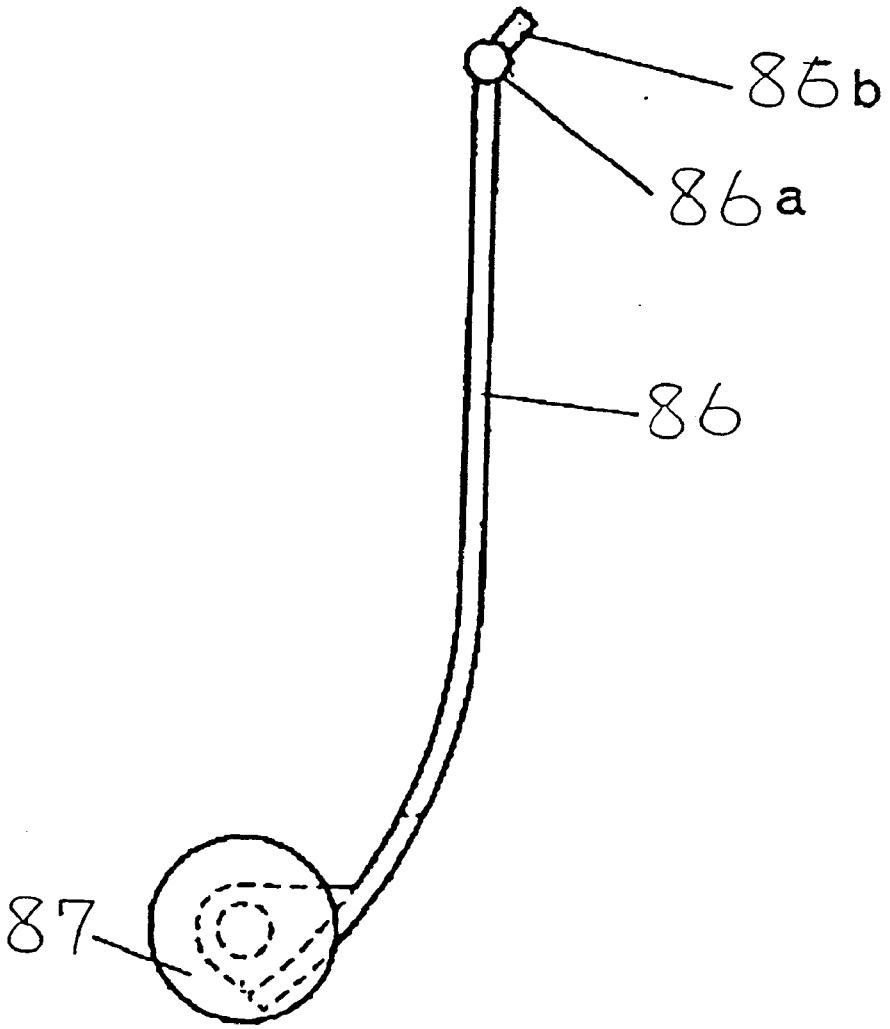
FIG. 24 is a side view of a support portion of the electric vacuum cleaner.

A support portion 86 has its rotational center near a hose fixing portion 88 which serves to fix a hose 83 to the suction unit 71. With the cleaner main body 73 kept upright, when the hose 83 is removed from the hose fixing portion 88, the cleaner main body 73 does not fall down backwardly because of the support portion 86. As shown in FIG. 23 and FIG. 24, a rotary shaft 86*a* is formed in one piece therewith at the upper position and a small roller 87 as a traveling means is rotatably disposed at the lower end position, which is activated downwardly by a spring 89. A stopper 86*b* that serves to control the backward protrusion of the support portion 86 is formed in one piece therewith above the rotary shaft 86*a*. Also, when the hose 83 is fitted to the hose fixing portion 88, depression 83*a* formed in one piece with the hose 83 abuts on a guiding rib 86*c* provided in one piece with the support portion 86, pushing the support portion 86 forward, and thereby the hose is stored into the main body rear 73*b*.

A connection hose 90 serves to connect the suction port of the suction unit 71 to the hose fixing portion 88. A bearing 73*c* is disposed in the main body rear 73*b* and journals the support portion 86. A guard portion 86*d* is formed in one piece with the support portion 86 and partially covers the rear of the connection hose 90.

Actions in the above configuration will be described in the following. With the cleaner main body 73 kept upright, when the hose 83 is removed from the hose fixing portion 88, the retractable support portion 86 is pushed by the spring 89 and protruded backwardly from the center of the caster roller 84. When the hose 83 is fixed to the hose fixing portion 88, the depression 83*a* abuts on the guiding rib 86*c*, pushing the support portion 86 forwardly, and thereby the hose is stored into the main body rear 73*b*. Accordingly, the support portion 86 is automatically protruded only when needed, and it is possible without help of the user to prevent the cleaner main body 73 from falling down.

Also, since the small roller 87 is rotatably disposed at the lower end of the support portion 86, the support portion 86 may be smoothly retracted or protruded without catching therein even when the vacuum cleaner is operated on a long-pile fluffy carpet.

Also, since the support portion 86 is provided with guard portion 86*d*, when the cleaner main body 73 is used, it is possible to prevent the connection hose 90 from being damaged by obstructions or the like on the floor surface.

Figure 25:
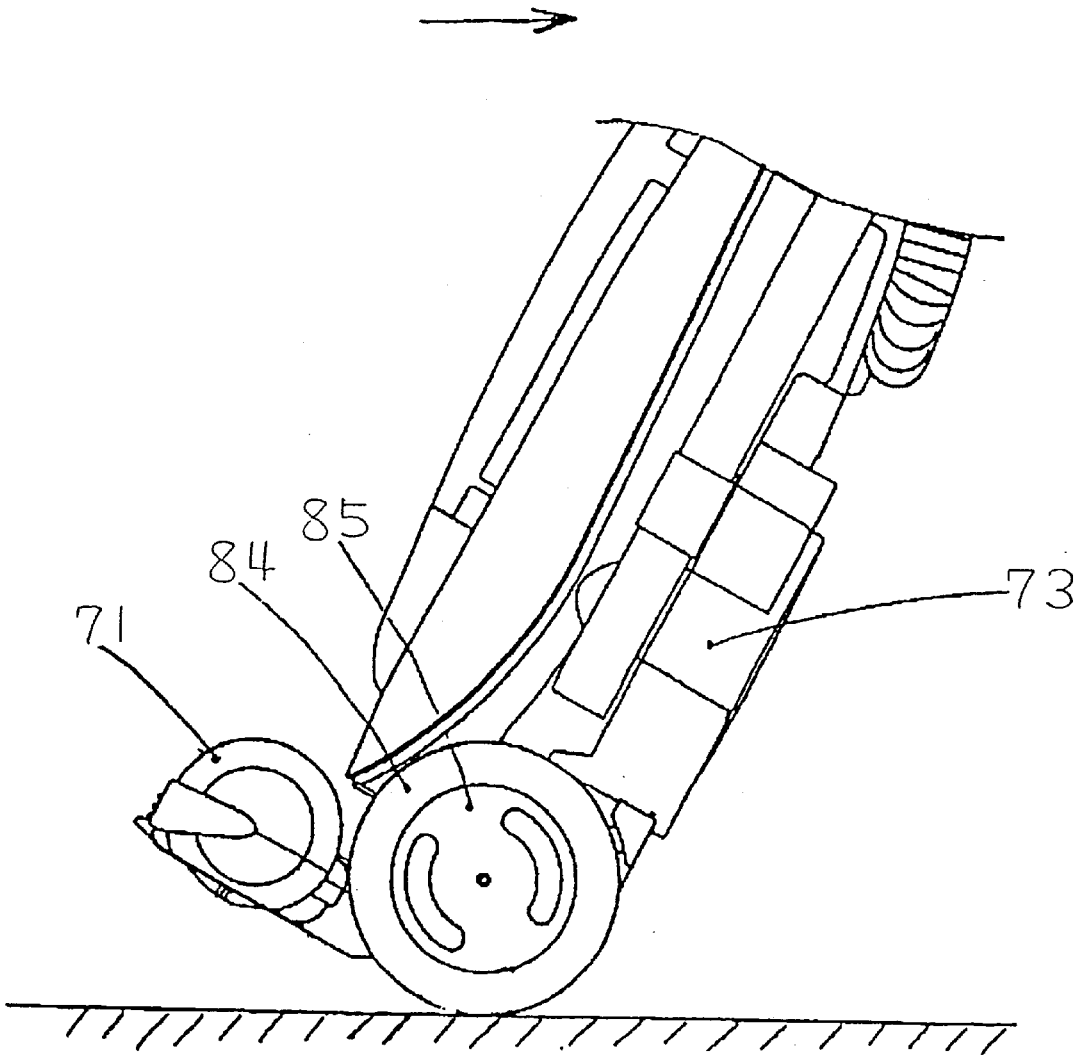
FIG. 25 is a side view of a state of the electric vacuum cleaner in operation.

Further, as shown in FIG. 25, when the cleaner main body 73 is rotated about the small roller 87 and is somewhat inclined backwardly, with the support portion 86 protruded backward, since the protrusion of the support portion 86 is controlled by the stopper 86*b*, the center of the small roller 87 moves forward ahead of the rotary shaft 86*a*, causing the support portion 86 to be automatically retracted due to the weight of the cleaner main body 73. Accordingly, when the cleaner main body 73 being inclined is moved with the hose 83 disconnected, the support portion 86 may be automatically retracted. Further, it is possible to improve the usability.

In this configuration, when the suction unit 71 and the detachable hose 83 are removed, the support portion 86 protrudes backward behind the rotational center of the caster roller 84 in order to support the cleaner main body 73 in an upright position. Accordingly, when cleaning a place behind the cleaner main body 73 with an attachment or the like fitted thereto, removing the hose 83 from the suction unit 71, the cleaner main body 73 does not fall down in the backward direction even when the hose 83 is strongly pulled backward. In this way, it is possible to improve the safety and the usability.

Also, when the hose 83 is fitted to the hose fixing portion 88, a part of the hose 83 pushes the support portion 86 forward and abuts thereon, causing the support portion 86 to be retracted. Thus, the support portion 86 may be retracted without any help of the user.

Also, there is provided depression 83*a* at the abutment against the support portion 86 of hose 83, and a part of the support portion 86 is inserted into the depression 83*a*. So, when the hose 83 is fitted to the hose fixing portion 88, the support portion 86 may be easily pushed forward by the hose 83.

Further, the small roller 87 is mounted at the lower end portion of the support portion 86 which comes in contact with the floor surface. So, it is possible to smoothly protrude or retract the support portion 86 even when operating the vacuum cleaner on a long-pile fluffy carpet.

Also, the suction port of suction unit 71 is connected to the hose fixing portion 88 by means of the connection hose 90, with the support portion 86 retracted, the connection hose 90 is covered by guard portion 86*d*. Accordingly, when the cleaner main body 73 is used, it is possible to prevent the connection hose 90 from being damaged by obstructions or the like on the floor surface.

Further, when the cleaner main body 73 is somewhat backwardly inclined about the portion contacting with the floor surface at the lower end of the support portion 86, with the support portion 86 protruded backward, the portion contacting with the floor surface at the lower end of support portion 86 comes ahead of the upper rotational center of the support portion 86, causing the support portion 86 to be automatically retracted due to the weight of the cleaner main body 73. Accordingly, when the cleaner main body 73 being inclined is moved with the hose 83 disconnected, the support portion 86 may be automatically retracted.

Figure 27:
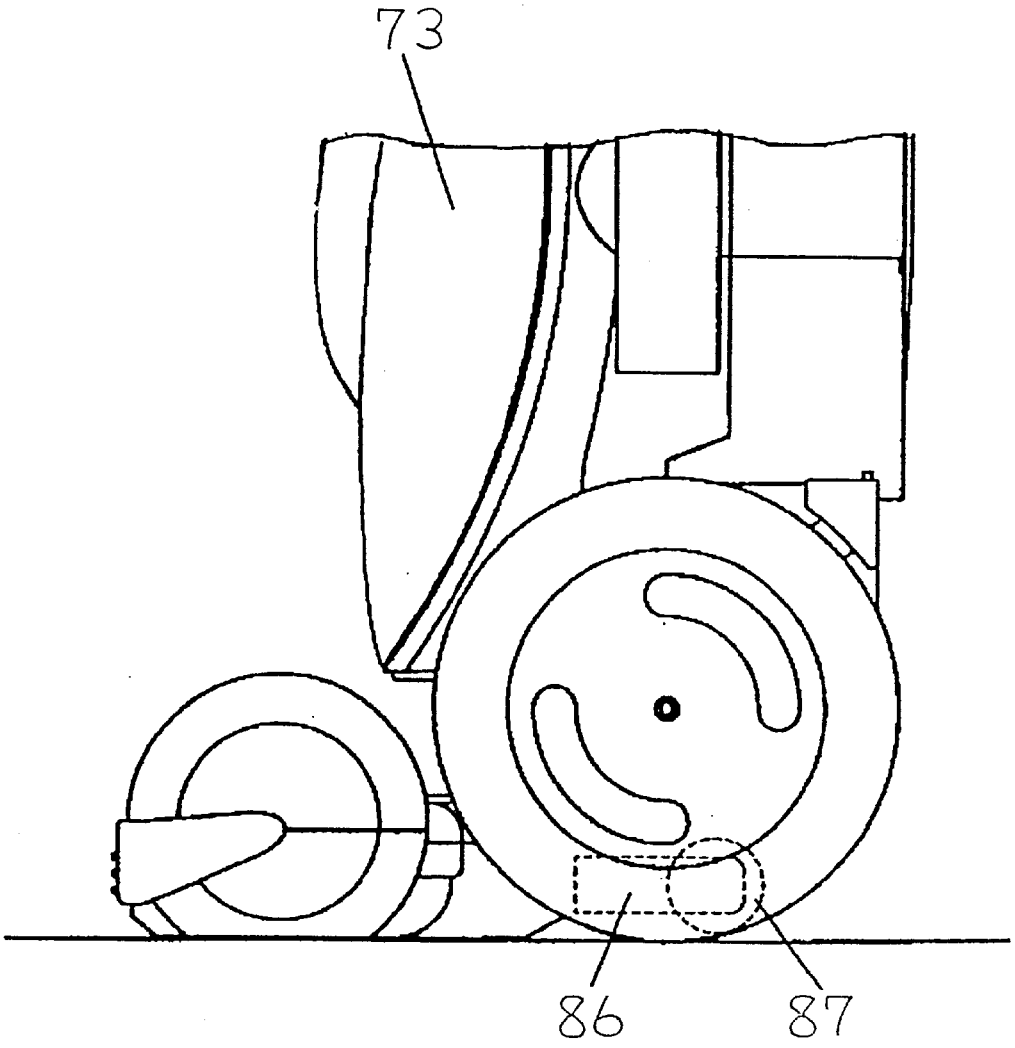
FIG. 27 is an enlarged side view of essential parts of the electric vacuum cleaner.
Figure 28:
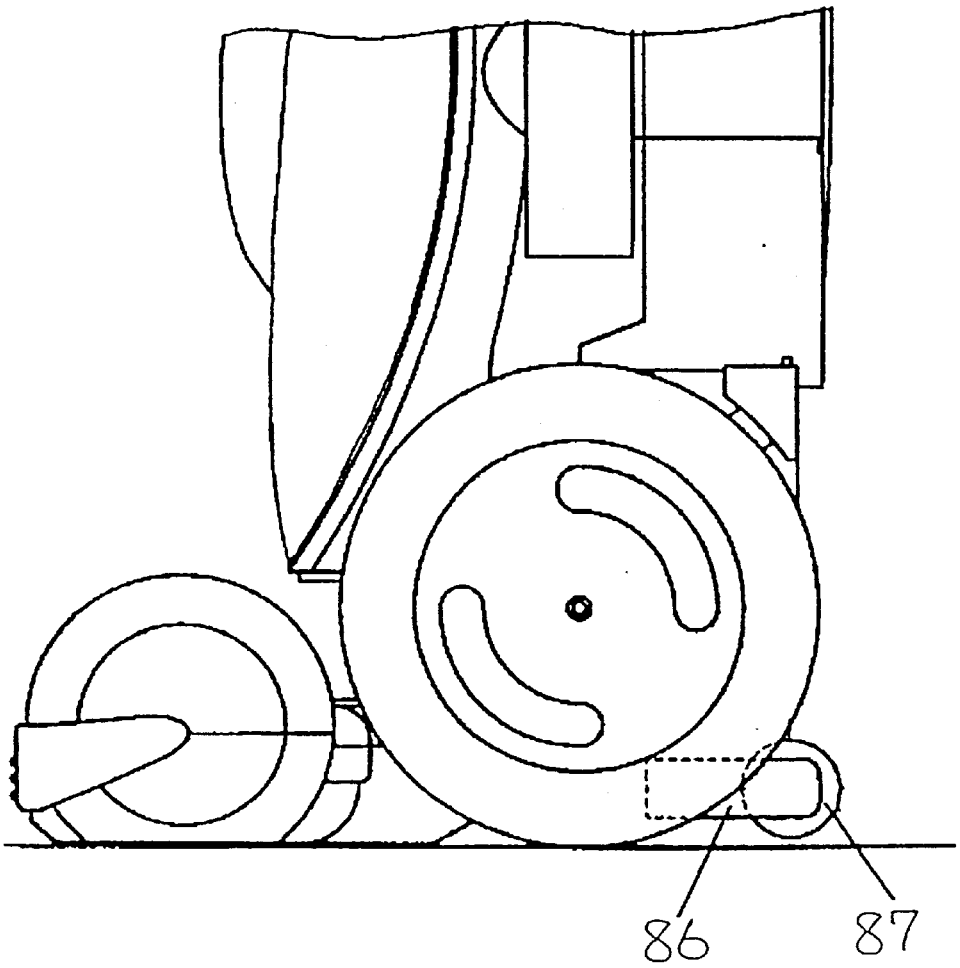
FIG. 28 is an enlarged side view of essential parts of the electric vacuum cleaner.

Next, the fifth embodiment of the present invention will be described with reference to FIG. 26~FIG. 28. In this embodiment, the support portion 86 used in the fourth embodiment is electrically protruded and retracted.

Figure 26:
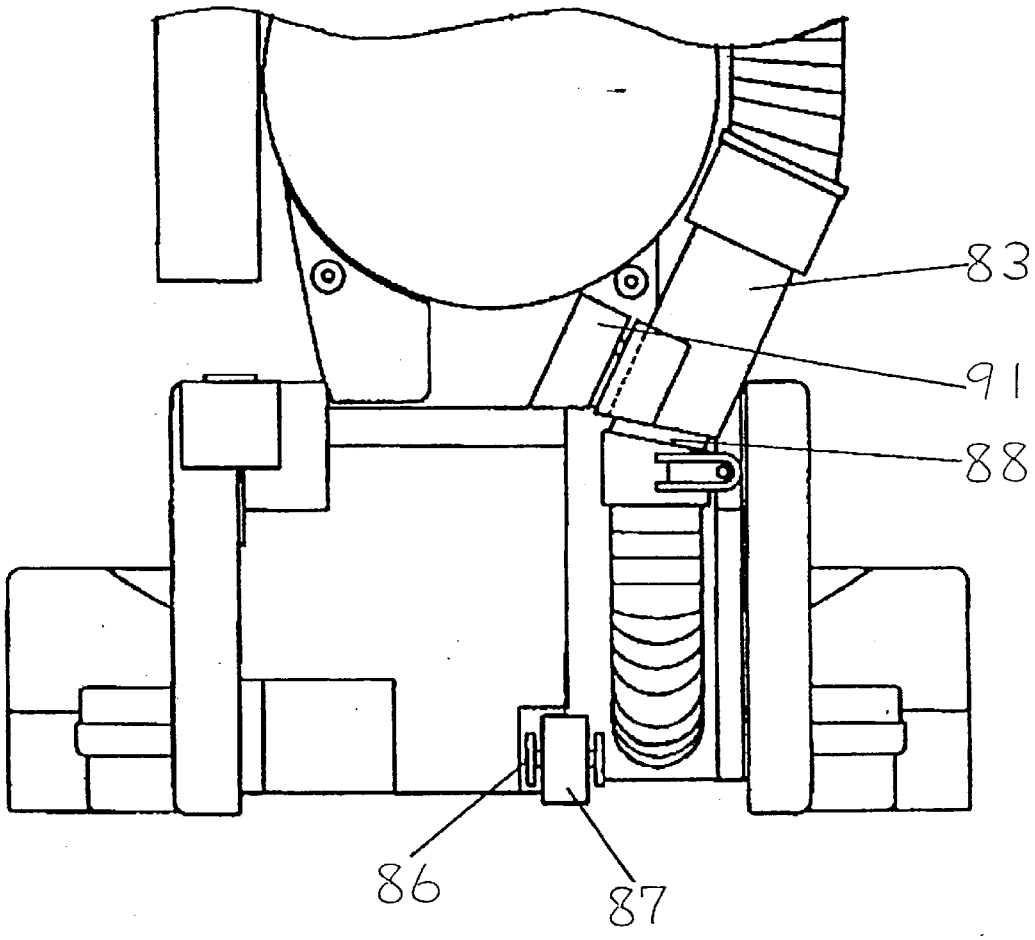
FIG. 26 is an enlarged rear view of essential parts of an electric vacuum cleaner in accordance with the fifth embodiment of the present invention.

As shown in FIG. 26, the configuration is such that a switch 91 turns OFF with a hose 83 fixed on a hose fixing portion 88, and tuns ON with the hose 83 removed from the hose fixing portion 88. A support portion 86 is protruded and retracted by means of a solenoid valve (not shown) and a tension spring (not shown). The support portion 86 is interlocked with the switch 91, and the support portion 86 is pushed backward when the switch 91 is ON. A small roller 87 is rotatably disposed at the rear end of the support portion 86.

Actions in the above configuration will be described in the following. When the hose 83 is fixed on the hose fixing portion 88, the switch 91 turns OFF and the support portion 86 is in a position as shown in FIG. 27. Next, when cleaning a place behind the cleaner main body 73, removing the hose 83 from the hose fixing portion 88, the switch 91 turns ON, and the support portion 86 is automatically pushed backward, as shown in FIG. 28, by the function of the solenoid. In this condition, the cleaner main body 73 may be prevented from falling down even when pulled backward.

Next, the sixth embodiment of the present invention will be described with reference to FIG. 29. In this embodiment, there is separately provided a switch which serves to protrude and retract the support portion 86 used in the fifth embodiment.

Figure 29:
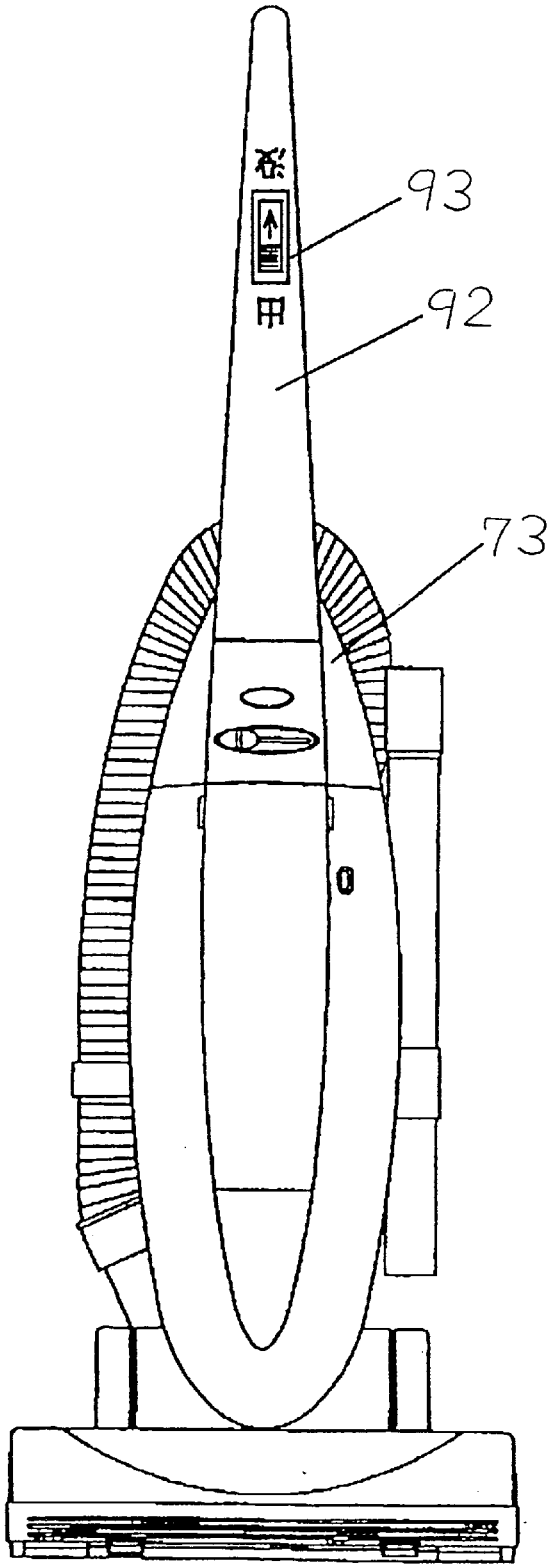
FIG. 29 is a front view of an electric vacuum cleaner in accordance with the sixth embodiment of the present invention.

As shown in FIG. 29, a hand switch 93 is disposed in handle 92 fitted to cleaner main body 73, and the switch serves to protrude and retract the support portion 86. With the hand switch 93 turned ON, the support portion 86 is pushed backward by the function of a solenoid valve (not shown) and a tension spring (not shown).

Actions in the above configuration will be described in the following. When the hand switch 93 is operated by the user, the support portion 86 is protruded backward. When the vacuum cleaner is left for a while with its main body 73 kept upright, using an attachment or doing the cleaning job on an undulated floor surface, it is possible to protrude or retract the support portion 86 as needed, thereby diversifying the mechanism to prevent the cleaner main body 73 from falling down backward.

Also, the hand switch 93 is disposed in the handle 92, but it is not necessary, in this embodiment, to limit the position of the handle 92. The hand switch 93 may be installed in other places such as near the attachment fixing portion of the cleaner main body 73, or in suction unit 71.

Next, the seventh embodiment of the present invention will be described with reference to FIG. 30~FIG. 33.

Figure 30:
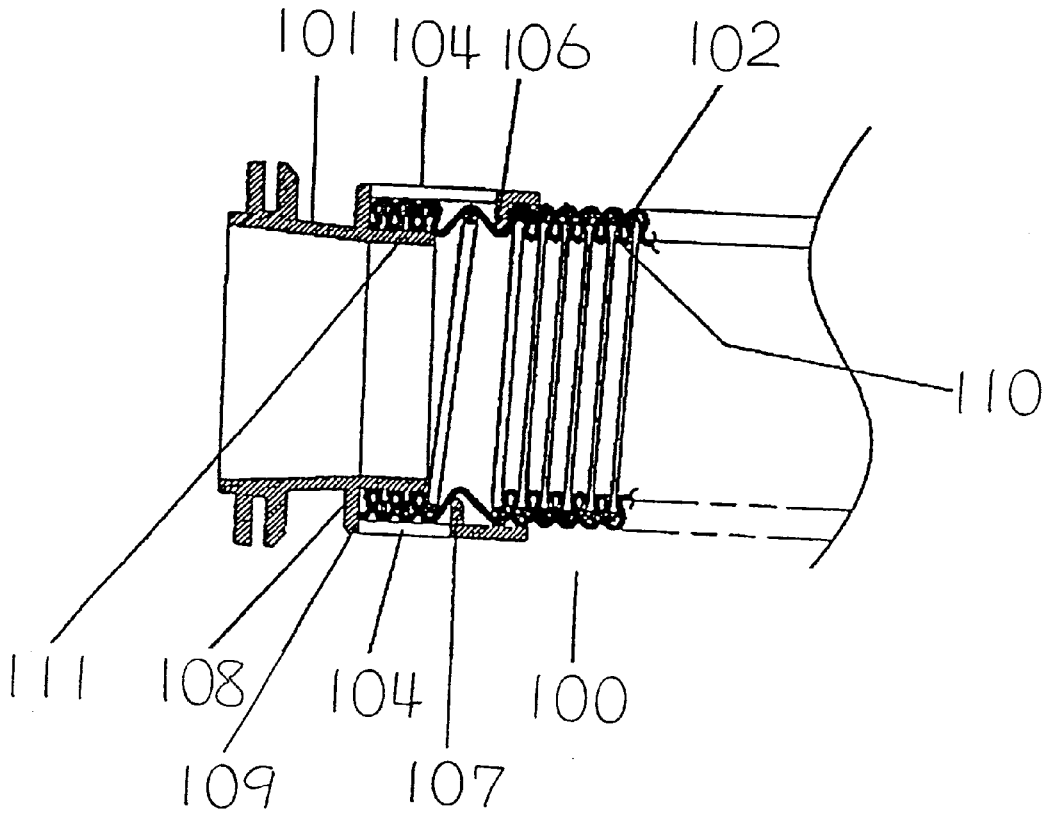
FIG. 30 is a sectional view of essential parts of a hose unit for electric vacuum cleaners in accordance with the seventh embodiment of the present invention.
Figure 31:
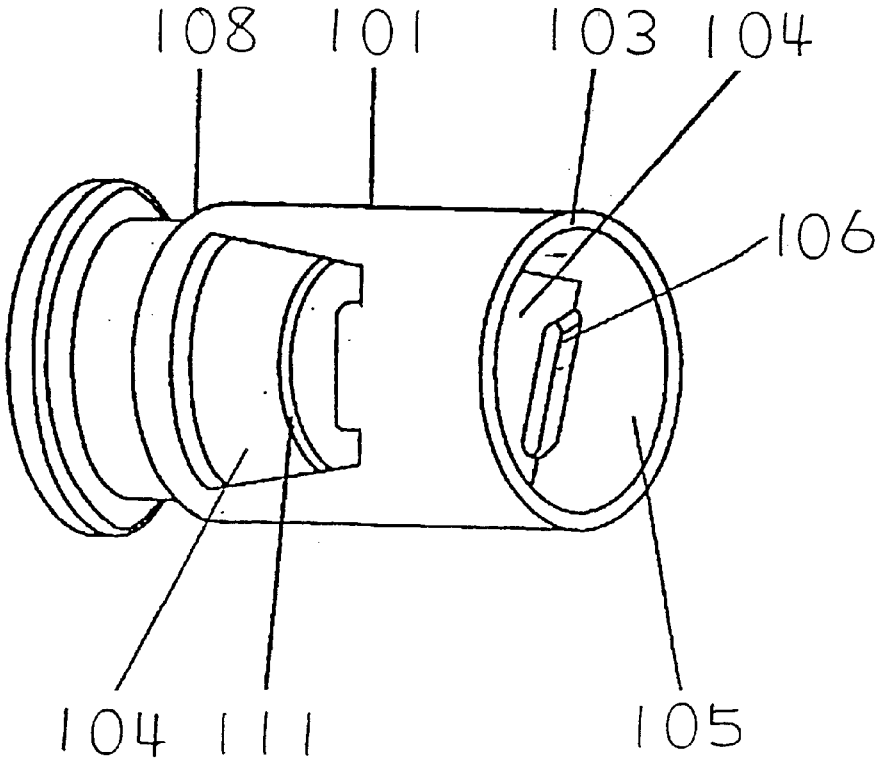
FIG. 31 is a perspective view of a hose cover of the hose unit for electric vacuum cleaners.

As shown in FIG. 30, a hose unit 100 includes a hose cover 101 and a hose 102 which are connected to a suction port (not shown) of a cleaner body (not shown). The hose cover 101, as shown in FIG. 31, has a cylindrical portion 103 in which the hose 102 is inserted. The cylindrical portion 103 has an opening 104. The cylindrical portion's inner wall 105 has a protrusion along the opening 104.

Figure 32:
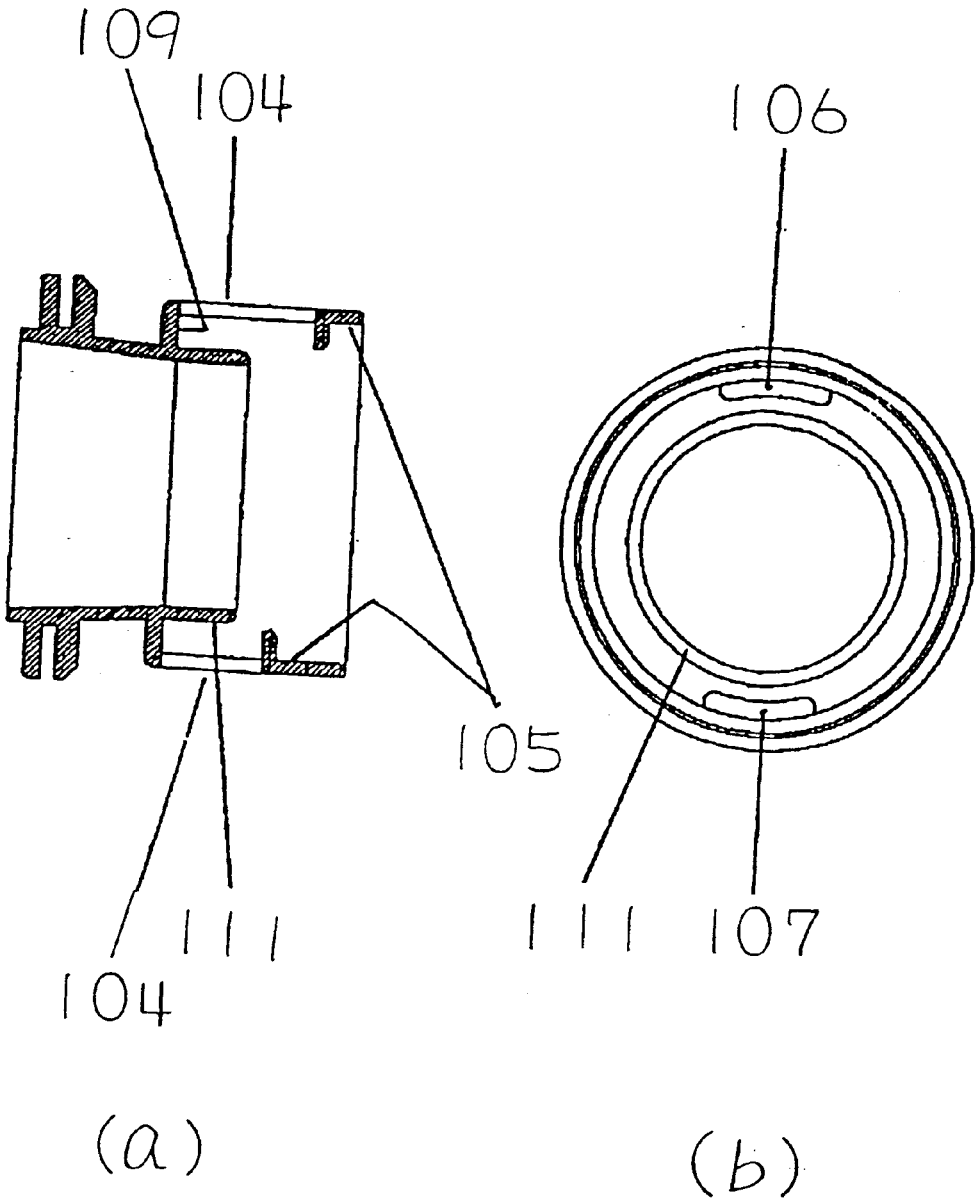
FIG. 32(*a*) is a sectional view of the hose cover of the hose unit for electric vacuum cleaners.
Figure 33:
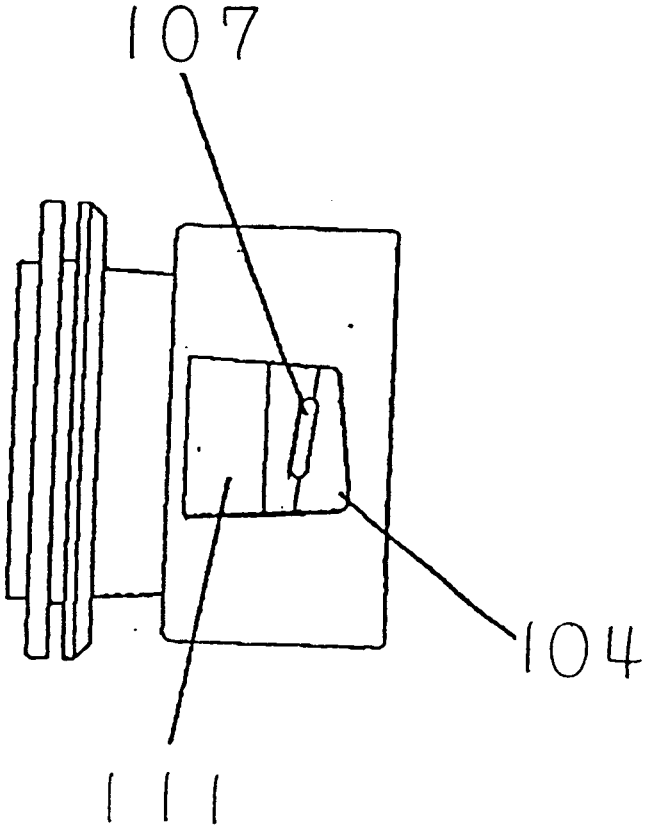
FIG. 33 is a front view of the hose cover of the hose unit for electric vacuum cleaners.
Figure 34:
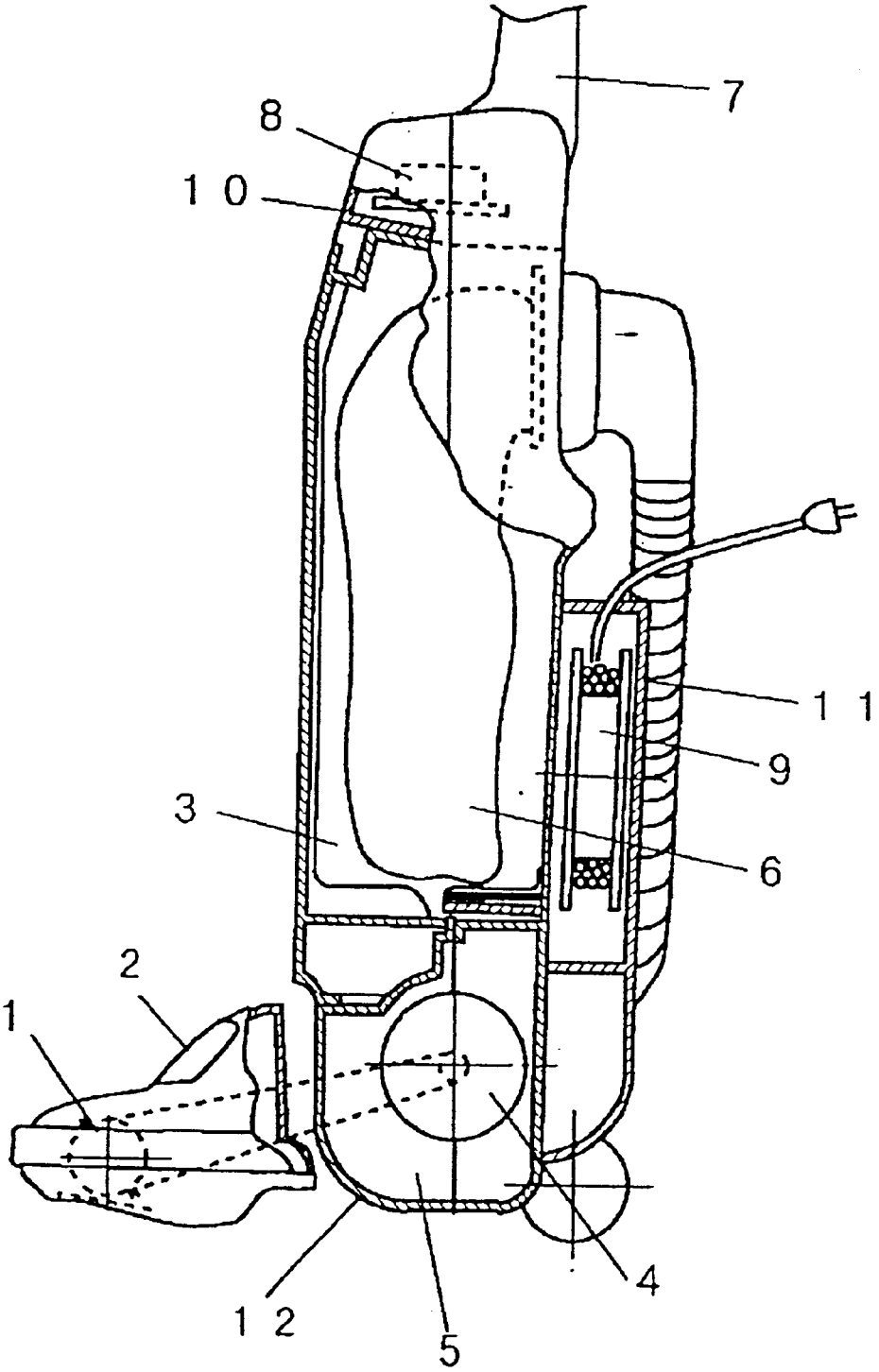
Fig. 34 PRIOR ART
FIG. 34 is a side view of a conventional electric vacuum cleaner with parts broken away.
Figure 35:
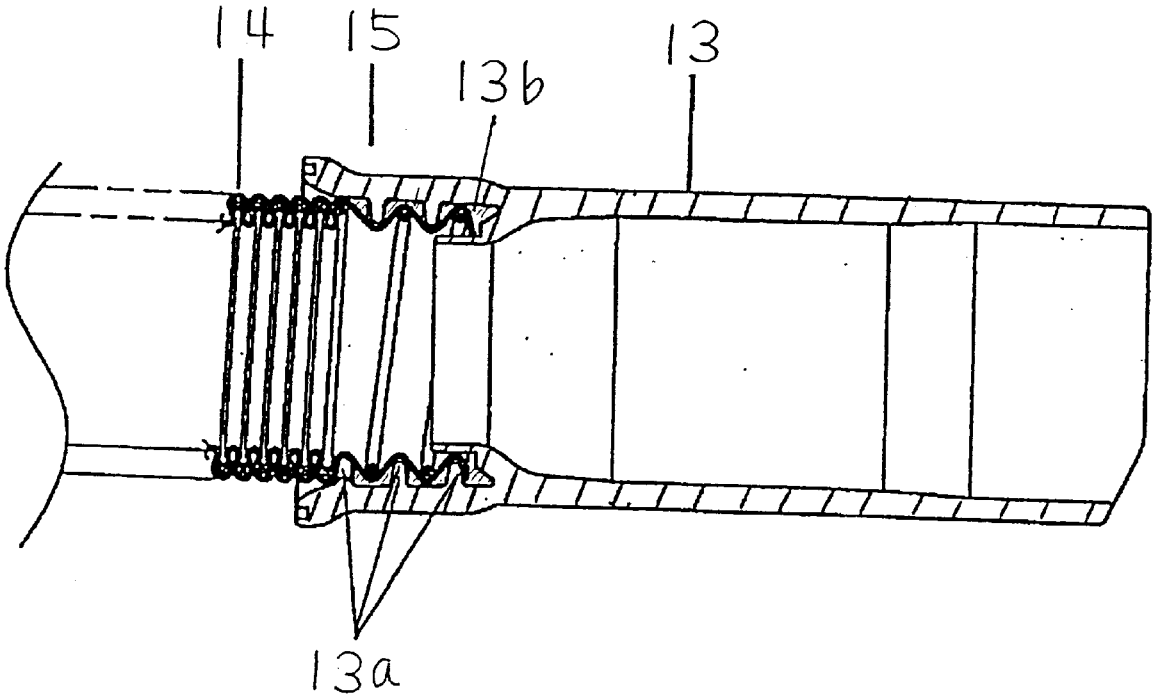
Fig. 35 PRIOR ART
FIG. 35 is a sectional view of essential parts of a hose unit for electric vacuum cleaners of conventional type.

Also, as shown in FIG. 32, there are provided a protrusion 106 and a protrusion 107 at generally opposite positions of the cylindrical portion's inner wall 105. The positions of these protrusions 106 and 107 are asymmetrical to the central axis of the cylindrical portion 103, and the locus of a point such that it connects the protrusions 106 and 107 is generally spiral as against the central axis of the cylindrical portion 103. Also, as shown in FIG. 33, there is provided an abutment wall 109 so that the end of the hose 102 abuts on an end portion 108 of the cylindrical portion 103. There is also provided an inner tube 111 that generally contacts with the inner periphery 110 of the hose 102.

Actions in the above embodiment will be described in the following. In assembling the hose unit 100, the hose 102 may be completely inserted into the hose cover 101, by turning the hose cover, until the end of the hose 102 abuts against the abutment wall 109 provided on the cylindrical portion 103. In that case, since there is provided the abutment wall 109 on the cylindrical portion 103, it is always possible to completely insert the hose 102 into the cylindrical portion 103.

Further, the opening 104 is formed in the cylindrical portion 103, and there are provided protrusions on the cylindrical portion's inner wall 105 along the opening 104 in the cylindrical portion 103. Accordingly, as compared with a conventional screw thread configuration, it is easier to construct the die to be used, and is possible to increase the protrusions 106 and 107 in height. So, it is also possible to maintain the fastening strength of the hose cover 101 and the hose 102 without using an adhesive agent to secure the hose cover 101 and the hose 102.

Further, the positions of the protrusions 106 and 107 are asymmetrical to the central axis of the cylindrical portion 103, and the locus of a point such that it connects the protrusions 106 and 107 is generally spiral as against the central axis of the cylindrical portion 103. Accordingly, it is easy to insert the hose 102 into the hose cover 101, thereby facilitating the assembling job, and the protrusions 106 and 107 may be inserted into the spirally formed depression. As a result, the fastening strength of the hose cover 101 and the hose 102 may be increased. And, by forming the inner tube 111, which generally contacts with the inner periphery 110 of the hose 102, on the hose cover 101, it is possible to make the hose 102 and the hose cover 101 to come in air-tight contact with each other.

Thus, the hose unit 100 in accordance with the present embodiment is not complicated in die construction and assures a low cost. Also, it is possible to maintain the fastening strength of the hose cover 101 and the hose 102 without using an adhesive agent to secure the hose cover 101 and the hose 102, thereby improving the assembling workability and quality.

Further, by installing the above hose unit for electric vacuum cleaners at one end of the hose at least which connects the dust collecting chamber to the suction unit, it is possible to make the assembling job easier and to provide an inexpensive electric vacuum cleaner.

What is claimed is:

1. An electric vacuum cleaner, comprising:

a cleaner main body, and a suction unit which is rotatably disposed at the bottom of said cleaner main body and is provided with a suction port and a rotary brush, wherein said cleaner main body includes a fan chamber equipped with an electric fan, a dust collecting chamber located above said fan chamber, a handle having a grip portion located above said dust collecting chamber, a first cover disposed on a rear surface of said cleaner main body, and a cord winding device;

wherein removal of said first cover allows access to said electric fan and access to said cord winding device.

2. The electric vacuum cleaner as defined in claim 1, further comprising a second cover disposed on said rear surface of said cleaner main body, said second cover securing said handle to said cleaner main body.

3. The electric vacuum cleaner as defined in claim 2, wherein said cleaner main body further includes a control circuit board, and wiring coupling said electric fan to said control circuit board, and wherein said wiring is arranged between said dust collecting chamber and said first cover at the rear of said dust collecting chamber.

4. The electric vacuum cleaner as defined in claim 2, further comprising a hose, an air intake pipe, a connection pipe, and a protrusion, wherein said dust collecting chamber has a connection port, said protrusion is generally arcuate in shape, said air intake pipe is installed at said connection port, one end of said hose is detachably connected to said air intake pipe, said connection pipe is coupled to said suction port of said suction unit, the other end of said hose is detachably connected to said connection pipe, and said protrusion is disposed at the rear of said cleaner main body.

5. The electric vacuum cleaner as defined by claim 2, further comprising a control circuit board, said control circuit board being accessible upon removal of said second cover.

6. The electric vacuum cleaner as defined in claim 1, further comprising a hose, an air intake pipe, a connection pipe, and a protrusion, wherein said dust collecting chamber has a connection port, said protrusion is generally arcuate in shape, said air intake pipe is installed at said connection port, one end of said hose is detachably connected to said air intake pipe, said connection pipe is coupled to said suction port of said suction unit, the other end of said hose is detachably connected to said connection pipe, and said protrusion is disposed at the rear of said cleaner main body.

7. The electric vacuum cleaner as defined by claim 1, wherein said cord winding device is disposed between said first cover and said dust collecting chamber.

* * * * *